US012435581B2

(12) United States Patent
Butterfield et al.

(10) Patent No.: US 12,435,581 B2
(45) Date of Patent: Oct. 7, 2025

(54) STANDOFF FOR WIRELINE

(71) Applicant: Chevron U.S.A. Inc., San Ramon, CA (US)

(72) Inventors: Albert Eugene Butterfield, Novato, CA (US); Mayank Malik, Houston, TX (US); Mark Allen Gracy, Napa, CA (US); Brian Christopher Weber, Martinez, CA (US)

(73) Assignee: CHEVRON U.S.A. INC., San Ramon, CA (US)

( * ) Notice: Subject to any disclaimer, the term of this patent is extended or adjusted under 35 U.S.C. 154(b) by 0 days.

(21) Appl. No.: 18/717,857

(22) PCT Filed: Oct. 24, 2023

(86) PCT No.: PCT/US2023/077673
§ 371 (c)(1),
(2) Date: Jun. 7, 2024

(87) PCT Pub. No.: WO2025/090076
PCT Pub. Date: May 1, 2025

(65) Prior Publication Data
US 2025/0257617 A1 Aug. 14, 2025

(51) Int. Cl.
*E21B 17/10* (2006.01)

(52) U.S. Cl.
CPC ..... *E21B 17/1085* (2013.01)

(58) Field of Classification Search
CPC ..... E21B 17/1085
See application file for complete search history.

(56) References Cited

U.S. PATENT DOCUMENTS 1,794,278 A * 2/1931 Carney ..... E21B 17/1085 174/136
3,692,109 A 9/1972 Grayson
7,434,627 B2 * 10/2008 Turley ..... E21B 17/1042 166/138
8,733,455 B2 * 5/2014 Shaikh ..... E21B 17/1057 166/380

(Continued)

OTHER PUBLICATIONS

Kari Rodriquez, PCT International Search Report, Mar. 5, 2024, 2 pages, US as receiving office.

(Continued)

*Primary Examiner* — Taras P Bemko
(74) *Attorney, Agent, or Firm* — Smith & Woldesenbet Law Group, PLLC

(57) ABSTRACT

A wireline standoff can include a base comprising a base body having a base channel that traverses a thickness of the base body along its length, where the base channel has a width and a depth that are large enough to receive the wireline. The wireline standoff can also include an end piece having an end piece body having an end piece channel that traverses a thickness of the end piece body along the end piece length, where the end piece channel has a width and a depth that are large enough to receive the wireline. The base and the end piece are in a default position when the base channel and the end piece channel are aligned and in a secured position when the end piece is moved relative to the base so that the base channel and the end piece channel are misaligned with each other.

20 Claims, 17 Drawing Sheets

(56) References Cited

U.S. PATENT DOCUMENTS

| | | | | |
|---|---|---|---|---|
| 9,790,748 | B2 * | 10/2017 | Hradecky | E21B 23/14 |
| 11,125,025 | B1 | 9/2021 | Wheater et al. | |
| 11,384,634 | B2 * | 7/2022 | Lanticq | E21B 47/135 |
| 2012/0031609 | A1 | 2/2012 | Wheater et al. | |
| 2022/0243582 | A1 | 8/2022 | Wheater et al. | |
| 2023/0024070 | A1 * | 1/2023 | Wheater | E21B 17/1085 |

OTHER PUBLICATIONS

Kari Rodriquez, Written Opinion of the International Search Authority, Mar. 5, 2024, 5 pages, US as receiving office.

Frank Brindle et al., Use of New Wireline Conveyance Technologies on an Offshore Abu Dhabi Well Saves Significant Rig Time and Results in Improved Sonic and Nuclear Magnetic Resonance Data Quality, Society of Petroleum Engineers SPE-192876-MS, Presented at the Abu Dhabi International Petroleum Exhibition & Conference held in Abu Dhabi, UAE, Nov. 12-15, 2018, 19 pages.

Guy Wheater et al., Wireline Cable Protection: Enabling Fluid Sampling in High-Risk Wellbores, Society of Petroleum Engineers SPE-193232-MS, Presented at the Abu Dhabi International Petroleum Exhibition & Conference held in Abu Dhabi, UAE, Nov. 12-15, 2018, 18 pages.

Guy Wheater et al., A Drilling Engineer's Guide to Optimizing Well Design for Wireline Operations, Society of Petroleum Engineers SPE-207644-MS, Presented at the Abu Dhabi International Petroleum Exhibition & Conference held in Abu Dhabi, UAE, Nov. 15-18, 2021, 21 pages.

Schlumberger, Wireline High-Tension Conveyance System, product brochure, copyrighted in 2013, 32 pages.

Guy Wheater (page champion), Wireline keyseating, https://petrowiki.spe.org/w/index.php?title=Wireline_keyseating&oldid=55939, page last edited on May 17, 2022, 3 pages.

* cited by examiner

STANDOFF FOR WIRELINE

CROSS-REFERENCE TO RELATED APPLICATIONS

This application claims priority under 35 U.S.C. § 371 to Patent Cooperation Treaty Patent Application Serial Number PCT/US23/77673, titled "Standoff For Wireline" and filed on Oct. 24, 2023, the entire contents of which are hereby incorporated herein by reference.

TECHNICAL FIELD

The present disclosure relates generally to wireline systems, and more particularly to systems, methods, and devices for standoffs for wirelines used in subterranean wellbores.

BACKGROUND

A wireline operation within a subterranean wellbore can involve placing a wireline tool at the end of a long wireline cable and dropping the wireline tool thousands of feet into the wellbore to collect information (e.g., measure parameters, capture images) within the wellbore. Once the information is collected, the wireline cable is pulled up to remove the wireline tool. In alternative cases, a wireline operation can involve using the wireline cable to retrieve ("fish") a tool or component from the wellbore or place a tool or component in the wellbore. The wireline cable is often made of a semi-flexible metal material.

Since wellbores are not completely straight and vertical along their length, there are sections of the wellbore that can impose high degrees of friction on the wireline during a wireline operation as the wireline is being lowered into and/or raised out of a wellbore. When too much friction results, the wireline can degrade. In extreme cases, the wireline breaks, resulting in tremendous costs (e.g., rig time, non-use of personnel, modification of wellbore, shutting in wellbore). Within a wellbore, a wireline can get damaged against non-smooth portions of a subterranean formation, a non-smooth wall of casing, and/or a step feature in the casing. Similarly, the casing and/or subterranean formation that forms the wellbore can be damaged by a wireline during a wireline operation.

SUMMARY

In general, in one aspect, the disclosure relates to a wireline standoff, which may include a base having a base body having a base length between a first end and a second end, where the first end has a first coupling feature, where the base body includes a base channel formed therein that extends along the base length of the base body, and where the base channel has a width and a depth that are configured to be large enough to receive a first lengthwise portion of the wireline. The wireline standoff may also include an end piece movably coupled to the first end of the base, where the end piece includes an end piece body and a second coupling feature that is configured to couple to the first coupling feature of the base, where the end piece body has formed therein an end piece channel that extends along an end piece length of the end piece body, and where an end piece channel has a width and a depth that are configured to be large enough to receive a second lengthwise portion of the wireline. The base and the end piece may be configured to be in a default position when the base channel and the end piece channel are aligned with each other so that the base channel is configured to receive the first lengthwise portion of the wireline simultaneously with when the end piece channel is configured to receive the second lengthwise portion of the wireline. The base and the end piece may be configured to be in a secured position when the end piece is moved relative to the base using the first coupling feature and the second coupling feature so that the base channel and the end piece channel are misaligned with each other while the first lengthwise portion of the wireline is positioned in the base channel and while the second lengthwise portion of the wireline is positioned in the end piece channel.

In other aspects, the disclosure relates to a wireline standoff assembly, which may include a wireline having a wireline thickness. The wireline standoff assembly may also include a wireline standoff encasing a portion of the wireline. The wireline standoff of the wireline standoff assembly may include a base having a base body with a base length between a first end and a second end, where the first end has a first coupling feature, where the base body includes a base channel formed therein that extends along the base length of the base body, and where the base channel has a width and a depth that are configured to be large enough to receive a first part of the portion of the wireline. The wireline standoff of the wireline standoff assembly may also include an end piece movably coupled to the first end of the base, where the end piece includes an end piece body and a second coupling feature that is coupled to the first coupling feature of the base, where the end piece body has formed therein an end piece channel that extends along an end piece length of the end piece body, and where the end piece channel has a width and a depth that are configured to be large enough to receive a second part of the portion of the wireline. The base and the end piece may be configured to be in a default position when the base channel and the end piece channel are aligned with each other so that the base channel is configured to receive the first part of the portion of the wireline simultaneously with when the end piece channel is configured to receive the second part of the portion of the wireline. The base and the end piece may be configured to be in a secured position when the end piece is moved relative to the base using the first coupling feature and the second coupling feature so that the base channel and the end piece channel are misaligned with each other while the first lengthwise portion of the wireline is positioned in the base channel and while the second lengthwise portion of the wireline is positioned in the end piece channel.

In yet other aspects, the disclosure relates to a wellbore system, which may include a wellbore disposed in a subterranean formation. The wellbore system may also include field equipment located at a surface adjacent to the wellbore. The wellbore system may further include a wireline having a wireline thickness, where the field equipment is configured to lower the wireline into and extract the wireline from the wellbore. The wellbore system may also include a wireline standoff encasing a portion of the wireline. The wireline standoff of the wellbore system may include a base having a base body having a base length between a first end and a second end, where the first end has a first coupling feature, where the base body includes a base channel formed therein that extends along the base length of the base body, and where the base channel has a width and a depth that are configured to be large enough to receive a first part of the portion of the wireline. The wireline standoff of the wellbore system may also include an end piece movably coupled to the first end of the base, where the end piece includes an end piece body and a second coupling feature that is coupled to the first coupling feature of the base, where the end piece body has formed therein an end piece channel that extends along an end piece length of the end piece body, and where the end piece channel has a width and a depth that are configured to be large enough to receive a second part of the portion of the wireline. The base and the end piece may be configured to be in a default position when the base channel and the end piece channel are aligned with each other so that the base channel is configured to receive the first part of the portion of the wireline at the surface simultaneously with when the end piece channel is configured to receive the second part of the portion of the wireline. The base and the end piece may be configured to be in a secured position when the end piece is moved relative to the base at the surface using the first coupling feature and the second coupling feature so that the base channel and the end piece channel are misaligned with each other while the first lengthwise portion of the wireline is positioned in the base channel and while the second lengthwise portion of the wireline is positioned in the end piece channel.

These and other aspects, objects, features, and embodiments will be apparent from the following description and the appended claims.

BRIEF DESCRIPTION OF THE DRAWINGS

The drawings illustrate only example embodiments and are therefore not to be considered limiting in scope, as the example embodiments may admit to other equally effective embodiments. The elements and features shown in the drawings are not necessarily to scale, emphasis instead being placed upon clearly illustrating the principles of the example embodiments. Additionally, certain dimensions or positions may be exaggerated to help visually convey such principles. In the drawings, the same reference numerals used in different figures may designate like or corresponding but not necessarily identical elements.

DETAILED DESCRIPTION

Figure 1:
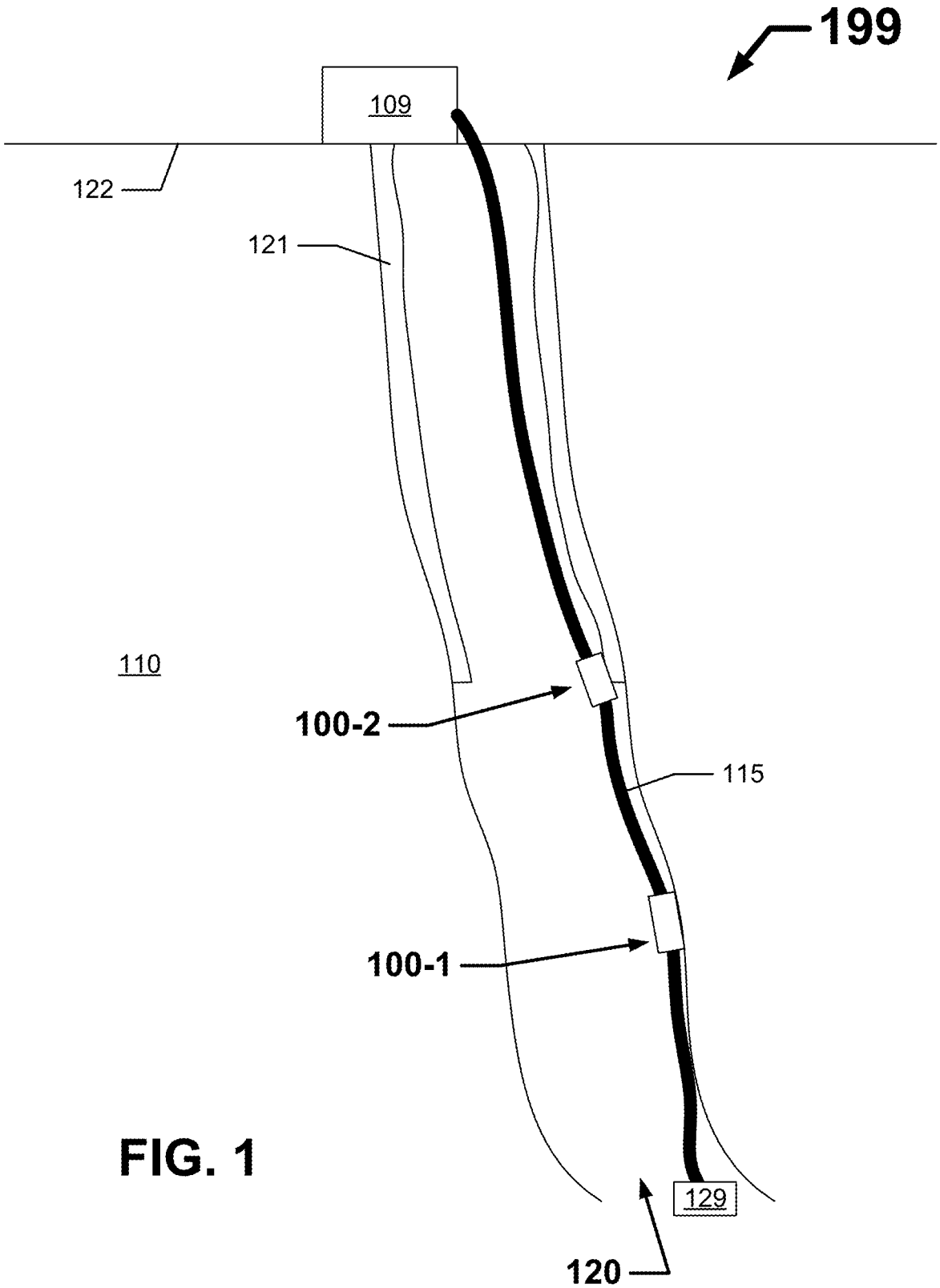
FIG. 1 shows a wireline system according to certain example embodiments.

In general, example embodiments provide systems, methods, and devices for standoffs for wirelines. Example embodiments can provide a number of benefits. Such benefits can include, but are not limited to, minimal interruption time of a wireline operation, targeted protection of a wireline within a wellbore, ease of position changes, ease of installation and uninstallation with respect to a wireline, and compliance with industry standards that apply to wireline operations. While example embodiments described herein are directed for use with wirelines, in alternative embodiments, an example standoff may be used additionally or alternatively with other types of cables and/or wires (e.g., electrical cables). Also, while example embodiments described herein are directed for use in a wellbore environment, in alternative embodiments, an example standoff may be used in any of a number of other environments (whether hazardous or otherwise) in which a cable or wire can use targeted protection from damage caused by portions of such other environments.

In addition, or in the alternative, example embodiments may be used to help protect parts of the casing and/or formation wall of a wellbore from friction generated by a wireline. As defined herein, a user may be any person that interacts with a wireline or associated wireline operation. Examples of a user may include, but are not limited to, a drilling engineer, a wireline engineer, a roughneck, a company representative, a mechanic, an operator, an employee, a consultant, a contractor, and a manufacturer's representative.

Example standoffs for wirelines can be made of one or more of a number of suitable materials to allow the standoffs to meet certain standards and/or regulations while also maintaining durability in light of the one or more conditions under which the standoffs, including components thereof, may be exposed. Examples of such materials can include, but are not limited to, aluminum, stainless steel, fiberglass, glass, plastic (e.g., polytetrafluoroethylene (PTFE), nylon), a polymer (e.g., an acetal homopolymer, a copolymer of terephthalic acid (1,4) and ethylene glycol), ceramic, and rubber.

Example standoffs, or portions or components thereof, described herein can be made from a single piece (e.g., from a mold, using injection molding, using a die cast process, using a milling and/or lathing process, using an extrusion process, 3D printing). In addition, or in the alternative, example standoffs (including portions or components thereof) can be made from multiple pieces that are mechanically coupled to each other. In such a case, the multiple pieces can be mechanically coupled to each other using one or more of a number of coupling methods, including but not limited to epoxy, welding, fastening devices, compression fittings, mating threads, snap fittings, and slotted fittings. One or more pieces that are mechanically coupled to each other can be coupled to each other in one or more of a number of ways, including but not limited to fixedly, hingedly, removeably, slidably, rotatably, and threadably.

Components and/or features described herein can include elements that are described as coupling, fastening, securing, abutting against, in communication with, or other similar terms. Such terms are merely meant to distinguish various elements and/or features within a component or device and are not meant to limit the capability or function of that particular element and/or feature. For example, a feature described as a "coupling feature" can couple, secure, fasten, abut against, and/or perform other functions aside from merely coupling.

A coupling feature (including a complementary coupling feature) as described herein can allow one or more components and/or portions of an example standoff to become coupled, directly or indirectly, to one or more other components of the standoff and/or to a wireline. A coupling feature can include, but is not limited to, a clamp, a portion of a hinge, a channel, an aperture, a recessed area, a protrusion, a hole or other type of aperture, a slot, a tab, a detent, and mating threads. One portion of an example standoff can be coupled to another component or feature of the standoff and/or to a wireline by the direct use of one or more coupling features.

In addition, or in the alternative, a portion of an example standoff can be coupled to another component or feature of the standoff and/or to a wireline using one or more independent devices that interact with one or more coupling features disposed on a component or feature of the standoff. Examples of such devices can include, but are not limited to, a pin, a hinge, a fastening device (e.g., a bolt, a screw, a rivet), epoxy, glue, adhesive, and a spring. One coupling feature described herein can be the same as, or different than, one or more other coupling features described herein. A complementary coupling feature as described herein can be a coupling feature that mechanically couples, directly or indirectly, with another coupling feature.

The use of the terms "substantially", "about", "approximately", and similar terms applies to all numeric values, whether or not explicitly indicated. These terms generally refer to a range of numbers that one of ordinary skill in the art would consider as a reasonable amount of deviation to the recited numeric values (i.e., having the equivalent function or result). For example, this term may be construed as including a deviation of +10 percent of the given numeric value provided such a deviation does not alter the end function or result of the value. Therefore, an angle that is substantially perpendicular may be construed to be within a range from 81° to 99°. Furthermore, a range may be construed to include the start and the end of the range. For example, a range of 10% to 20% (i.e., range of 10%-20%) includes 10% and also includes 20%, and includes percentages in between 10% and 20%, unless explicitly stated otherwise herein. Similarly, a range of between 10% and 20% (i.e., range between 10%-20%) includes 10% and also includes 20%, and includes percentages in between 10% and 20%, unless explicitly stated otherwise herein.

A "subterranean formation" refers to practically any volume under a surface. For example, it may be practically any volume under a terrestrial surface (e.g., a land surface), practically any volume under a seafloor, etc. Each subsurface volume of interest may have a variety of characteristics, such as petrophysical rock properties, reservoir fluid properties, reservoir conditions, hydrocarbon properties, or any combination thereof. For example, each subsurface volume of interest may be associated with one or more of: temperature, porosity, salinity, permeability, water composition, mineralogy, hydrocarbon type, hydrocarbon quantity, reservoir location, pressure, etc. Those of ordinary skill in the art will appreciate that the characteristics are many, including, but not limited to: shale gas, shale oil, tight gas, tight oil, tight carbonate, carbonate, vuggy carbonate, unconventional (e.g., a permeability of less than 25 millidarcy (mD) such as a permeability of from 0.000001 mD to 25 mD)), diatomite, geothermal, mineral, etc. The terms "formation", "subsurface formation", "hydrocarbon-bearing formation", "reservoir", "subsurface reservoir", "subsurface area of interest", "subsurface region of interest", "subsurface volume of interest", and the like may be used synonymously. The term "subterranean formation" is not limited to any description or configuration described herein.

A "well" or a "wellbore" refers to a single hole, usually cylindrical, that is drilled into a subsurface volume of interest. A well or a wellbore may be drilled in one or more directions. For example, a well or a wellbore may include a vertical well, a horizontal well, a deviated well, and/or other type of well. A well or a wellbore may be drilled in the subterranean formation for exploration and/or recovery of resources. A plurality of wells (e.g., tens to hundreds of wells) or a plurality of wellbores are often used in a field depending on the desired outcome.

A well or a wellbore may be drilled into a subsurface volume of interest using practically any drilling technique and equipment known in the art, such as geosteering, directional drilling, etc. Drilling the well may include using a tool, such as a drilling tool that includes a drill bit and a drill string. Drilling fluid, such as drilling mud, may be used while drilling in order to cool the drill tool and remove cuttings. Other tools may also be used while drilling or after drilling, such as measurement-while-drilling (MWD) tools, seismic-while-drilling tools, wireline tools, logging-while-drilling (LWD) tools, or other downhole tools. After drilling to a predetermined depth, the drill string and the drill bit may be removed, and then the casing, the tubing, and/or other equipment may be installed according to the design of the well. The equipment to be used in drilling the well may be dependent on the design of the well, the subterranean formation, the hydrocarbons, and/or other factors.

A well may include a plurality of components, such as, but not limited to, a casing, a liner, a tubing string, a sensor, a packer, a screen, a gravel pack, artificial lift equipment (e.g., an electric submersible pump (ESP)), and/or other components. If a well is drilled offshore, the well may include one or more of the previous components plus other offshore components, such as a riser. A well may also include equipment to control fluid flow into the well, control fluid flow out of the well, or any combination thereof. For example, a well may include a wellhead, a choke, a valve, and/or other control devices. These control devices may be located on the surface, in the subsurface (e.g., downhole in the well), or any combination thereof. In some embodiments, the same control devices may be used to control fluid flow into and out of the well. In some embodiments, different control devices may be used to control fluid flow into and out of a well. In some embodiments, the rate of flow of fluids through the well may depend on the fluid handling capacities of the surface facility that is in fluidic communication with the well. The equipment to be used in controlling fluid flow into and out of a well may be dependent on the well, the subsurface region, the surface facility, and/or other factors. Moreover, sand control equipment and/or sand monitoring equipment may also be installed (e.g., downhole and/or on the surface). A well can on occasion use wireline services for wellbore evaluation ("logging"), equipment retrieval ("fishing"), conveyance of downhole tools, and the like. A well may also include any completion hardware that is not discussed separately. The term "well" may be used synonymously with the terms "borehole," "wellbore," or "well bore." The term "well" is not limited to any description or configuration described herein.

It is understood that when combinations, subsets, groups, etc. of elements are disclosed (e.g., combinations of components in a composition, or combinations of steps in a method), that while specific reference of each of the various individual and collective combinations and permutations of these elements may not be explicitly disclosed, each is specifically contemplated and described herein. By way of example, if an item is described herein as including a component of type A, a component of type B, a component of type C, or any combination thereof, it is understood that this phrase describes all of the various individual and collective combinations and permutations of these components. For example, in some embodiments, the item described by this phrase could include only a component of type A. In some embodiments, the item described by this phrase could include only a component of type B. In some embodiments, the item described by this phrase could include only a component of type C. In some embodiments, the item described by this phrase could include a component of type A and a component of type B. In some embodiments, the item described by this phrase could include a component of type A and a component of type C. In some embodiments, the item described by this phrase could include a component of type B and a component of type C. In some embodiments, the item described by this phrase could include a component of type A, a component of type B, and a component of type C. In some embodiments, the item described by this phrase could include two or more components of type A (e.g., A1 and A2). In some embodiments, the item described by this phrase could include two or more components of type B (e.g., B1 and B2). In some embodiments, the item described by this phrase could include two or more components of type C (e.g., C1 and C2). In some embodiments, the item described by this phrase could include two or more of a first component (e.g., two or more components of type A (A1 and A2)), optionally one or more of a second component (e.g., optionally one or more components of type B), and optionally one or more of a third component (e.g., optionally one or more components of type C). In some embodiments, the item described by this phrase could include two or more of a first component (e.g., two or more components of type B (B1 and B2)), optionally one or more of a second component (e.g., optionally one or more components of type A), and optionally one or more of a third component (e.g., optionally one or more components of type C). In some embodiments, the item described by this phrase could include two or more of a first component (e.g., two or more components of type C (C1 and C2)), optionally one or more of a second component (e.g., optionally one or more components of type A), and optionally one or more of a third component (e.g., optionally one or more components of type B).

In the foregoing figures showing example embodiments of standoffs for wirelines, one or more of the components shown may be omitted, repeated, and/or substituted. Accordingly, example embodiments of standoffs for wirelines should not be considered limited to the specific arrangements of components shown in any of the figures. For example, features shown in one or more figures or described with respect to one embodiment can be applied to another embodiment associated with a different figure or description.

In certain example embodiments, wireline systems having example standoffs are subject to meeting certain standards and/or requirements. Examples of entities that set such standards and/or requirements can include, but are not limited to, the Society of Petroleum Engineers, the American Petroleum Institute (API), the International Standards Organization (ISO), and the Occupational Safety and Health Administration (OSHA). Use of example embodiments described herein meet (and/or allow the wireline systems to meet) such standards and/or requirements when applicable.

If a component of a figure is described but not expressly shown or labeled in that figure, the label used for a corresponding component in another figure can be inferred to that component. Conversely, if a component in a figure is labeled but not described with respect to that figure, the description for such component can be substantially the same as the description for a corresponding component in another figure. The numbering scheme for the various components in the figures herein is such that each component is a three-digit number, and corresponding components in other figures have the identical last two digits.

In addition, a statement that a particular embodiment (e.g., as shown in a figure herein) does not have a particular feature or component does not mean, unless expressly stated, that such embodiment is not capable of having such feature or component. For example, for purposes of present or future claims herein, a feature or component that is described as not being included in an example embodiment shown in one or more particular drawings is capable of being included in one or more claims that correspond to such one or more particular drawings herein.

Example embodiments of standoffs for wirelines will be described more fully hereinafter with reference to the accompanying drawings, in which example embodiments of standoffs for wirelines are shown. Standoffs for wirelines may, however, be embodied in many different forms and should not be construed as limited to the example embodiments set forth herein. Rather, these example embodiments are provided so that this disclosure will be thorough and complete, and will fully convey the scope of standoffs for wirelines to those of ordinary skill in the art. Like, but not necessarily the same, elements (also sometimes called components) in the various figures are denoted by like reference numerals for consistency.

Terms such as "first", "second", "above", "below", "inner", "outer", "distal", "proximal", "end", "top", "bottom", "upper", "lower", "side", "left", "right", "front", "rear", and "within", when present, are used merely to distinguish one component (or part of a component or state of a component) from another. Such terms are not meant to denote a preference or a particular orientation. Such terms are not meant to limit embodiments of standoffs for wirelines. In the following detailed description of the example embodiments, numerous specific details are set forth in order to provide a more thorough understanding of the invention. However, it will be apparent to one of ordinary skill in the art that the invention may be practiced without these specific details. In other instances, well-known features have not been described in detail to avoid unnecessarily complicating the description.

FIG. 1 shows a wireline system 199 according to certain example embodiments. Specifically, FIG. 1 shows a diagram of a land-based system in which a wellbore 120 has been drilled or is being drilled in a subterranean formation 110 and in which example embodiments can be used. The wireline system 199 of FIG. 1 includes a wellbore 120 disposed in a subterranean formation 110 that was drilled using field equipment that includes, but is not limited to, a derrick, a tool pusher, a clamp, a tong, drill pipe, casing pipe, a drill bit, a wireline tool, a fluid pumping system, a motor, a variable frequency drive, and a compressor.

As the depth of the wellbore 120 increases, one or more casing strings 121 may be inserted into the wellbore 120 from the surface 122 and subsequently cemented to the wellbore 120 to stabilize the wellbore 120 and allow for the extraction of subterranean resources (e.g., oil, natural gas) from the subterranean formation 110. The casing string may be a number of pipes that are connected end-to-end using coupling features (e.g., mating threads) and/or another coupling component (e.g., a sub, a collar). A wellbore 120 may undergo multiple casing and cementing operations, where each casing and cementing operation covers part or all of a segment of the wellbore 120 or multiple segments of the wellbore 120. In such a case, the wellbore 120 can have a casing program using multiple casing strings 121 at different depths within the wellbore 120.

Each casing pipe of the casing string 121 can have a length and a width (e.g., outer diameter). The length of a casing pipe can vary. For example, a common length of a casing pipe is approximately 40 feet. The length of a casing pipe can be longer (e.g., 60 feet) or shorter (e.g., 10 feet) than 40 feet. The width of a casing pipe can also vary and can depend on the cross-sectional shape of the casing pipe. For example, when the cross-sectional shape of a casing pipe is circular, which is commonly the case, the width can refer to an outer diameter, an inner diameter, or some other form of measurement of the casing pipe. Examples of a width in terms of an outer diameter of a casing pipe can include, but are not limited to, 4½ inches, 7 inches, 7⅝ inches, 8⅝ inches, 10¾ inches, 13⅜ inches, 14 inches, and 30 inches. Under a casing program, the larger widths of the casing pipe are closer to the entry point at the surface 122, and the width gradually decreases by segment moving toward the distal end of the wellbore 120.

The size (e.g., width, length) of the casing string 121 can be based on the information gathered using some of the field equipment with respect to the subterranean wellbore 120. The walls of the casing string 121 have an inner surface that forms a cavity that traverses the length of the casing string 121. Each casing pipe of the casing string 121 can be made of one or more of a number of suitable materials, including but not limited to stainless steel. As discussed above, there is a gap, also called an annulus, between the outer surface of the casing string 121 and the wall of the wellbore 120. This gap is filled with cement at times. In some cases, stabilizers (not shown) or similar devices can be inserted along with the casing pipes and/or integrated with the casing pipe. These stabilizers help to keep the casing string 121 relatively centered within the wellbore 120.

The surface 122 can be ground level for an on-shore (also called land-based) application (as in this case) and the sea floor or seabed for an off-shore application. The point where the wellbore 120 begins at the surface 122 can be called the entry point. While not shown in FIG. 1, there can be multiple wellbores 120, each with its own entry point but that is located close to the other entry points, drilled into the subterranean formation 110. In such a case, the multiple wellbores 120 can be drilled at the same pad location.

The subterranean formation 110 can include one or more of a number of formation types, including but not limited to shale, limestone, sandstone, clay, sand, and salt. In certain embodiments, a subterranean formation 110 can include one or more reservoirs in which one or more subterranean resources (e.g., oil, gas, water, steam) can be located. One or more of a number of field operations (e.g., wireline, fracturing, coring, tripping, drilling, setting casing, extracting downhole resources) can be performed to reach an objective of a user with respect to the subterranean formation 110.

The wellbore 120 can have one or more of a number of segments, where each segment can have one or more of a number of dimensions. Examples of such dimensions can include, but are not limited to, size (e.g., diameter) of the wellbore 120, a curvature of the wellbore 120, a true vertical depth of the wellbore 120, a measured depth of the wellbore 120, and a horizontal displacement of the wellbore 120. A wellbore 120 can have one or more vertical (or substantially vertical) sections and/or one or more horizontal (or substantially horizontal) sections.

At the point in time captured in FIG. 1, a wireline operation is being performed on the wellbore 120. Specifically, wireline equipment 109 located at the surface 122 near the entry point is used to lower and subsequently raise a wireline 115 into the wellbore 120. The wireline 115 may be a flexible metal cable (e.g., a slickline cable, an electrical cable, a braided metal cable) used for well completion and/or intervention operations (e.g., fishing, conveyance of downhole tools, logging). The wireline 115 may have a thickness (e.g., a diameter) that is substantially constant or variable along its length. At the distal end of the wireline 115 may be one or more wireline tools 129. Examples of such wireline tools 129 may include, but are not limited to, natural gamma ray tools, nuclear tools, resistivity tools, sonic tools, ultrasonic tools, nuclear magnetic resonance tools, borehole seismic tools, and cased hole electric line tools.

As the wireline 115 is lowered into the wellbore 120 and subsequently removed from the wellbore 120 by the wireline equipment 109, the wireline 115 may be exposed to sharp edges and/or rough surfaces within the wellbore 120, whether from the casing string 121 or the subterranean formation 110. As a result of such interactions, the wireline 115 may become damaged or, in the worst case, severed or inoperable. Aside from the high cost of replacing and/or repairing the wireline 115, further retrieval from the wellbore 120 resulting from a severed wireline 115 and/or damage to the wireline tool 129 can add significant time and expense to a project.

In addition, or in the alternative, as the wireline 115 is lowered into the wellbore 120 and subsequently removed from the wellbore 120 by the wireline equipment 109, the wireline 115 may cause damage (e.g., generating rough surfaces, causing pitting, causing erosion) to the casing string 121 and/or to the wall of the wellbore 120 formed by the subterranean formation 110. Such damage to the casing string 121 and/or the subterranean formation 110 at the wellbore 120 may lead to damage of the wireline 115, to damage of other equipment used in the wellbore 120, and/or to delays and/or prohibition of subsequent subterranean field operations with respect to the wellbore 120.

In order to avoid or minimize the risk of the wireline 115, the casing string 121, and/or the wall of the subterranean formation 110 forming the wellbore 120 being damaged from interactions within the wellbore 120 during a wireline operation, example standoffs 100 may be used. Any number (e.g., one, 5, 40, 100, 250) of standoffs 100 may be used in a wireline operation. In this case, there are 2 standoffs 100 in use as of the point in time during the wireline operation of the wireline system 199 captured in FIG. 1. Standoff 100-1 encompasses a lengthwise portion of the wireline 115 approximately halfway between the bottom of the casing string 121 and the bottom of the wellbore 120, and standoff 100-2 encompasses a lengthwise portion of the wireline 115 approximately at the bottom of the casing string 121.

As the wireline 115 is lowered into the wellbore 120 by the wireline equipment 109, the process may be momentarily paused from time to time in order to install an example standoff 100 on a lengthwise section of the wireline 115. In some cases, a standoff 100 may be installed on the wireline 115 with little or no delay or slowing in lowering the wireline 115 into the wellbore 120. Similarly, as the wireline 115 is removed from the wellbore 120 by the wireline equipment 109, the process may be momentarily paused from time to time in order to remove an example standoff 100 from a lengthwise section of the wireline 115. In some cases, a standoff 100 may be removed from the wireline 115 with little or no delay or slowing in extracting the wireline 115 from the wellbore 120.

In certain example embodiments, each example standoff 100 is configured to be engaged with the wireline 115 in a relatively minimal amount of time. For example, an example standoff 100 may be engaged with the wireline 115 without the use of tools. As a result, there are minimal disruptions to the wireline operations as the wireline 115 is lowered into the wellbore 120. Similarly, each example standoff 100 may be configured to be disengaged (e.g., without the use of tools) from the wireline 115 in a relatively minimal amount of time. When a wireline system (e.g., wireline system 199) includes multiple example standoffs 100, as in this case, the configuration (e.g., number of parts, shape of each part, size of each part, configuration of coupling features) of one standoff 100 can be the same as, or different than, the configuration of one or more of the other standoffs 100. Each example standoff 100 is configured to absorb impacts of the wellbore 120 (e.g., the casing string 121, the subterranean formation 110) to protect the portion of the wireline 115 encased by the standoff 100 from wear.

Figure 2:
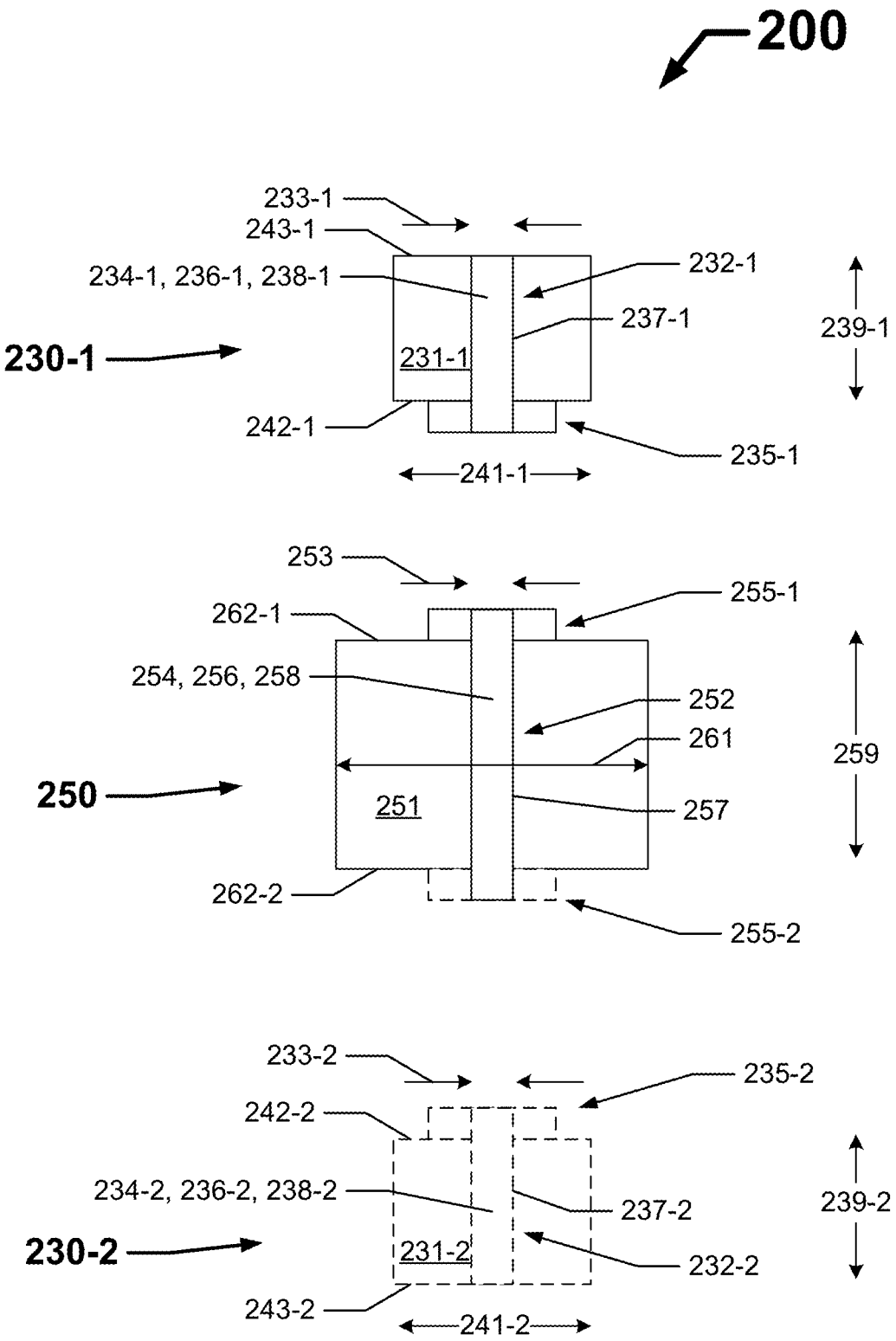
FIG. 2 shows a block diagram of a wireline standoff according to certain example embodiments.

FIG. 2 shows a block diagram of a wireline standoff 200 according to certain example embodiments. The standoff 200 can be substantially similar to the standoffs 100 of FIG. 1. The example standoff 200 includes multiple parts. For example, the standoff 200 of FIG. 2 includes a base 250, a first end piece 230-1, and an optional second end piece 230-2. The various adjacent parts of the standoff 200 may be permanently (but movably) coupled to each other. Alternatively, two or more adjacent parts of the standoff 200 may be detachable from each other.

The base 250 of the standoff 200 includes a body 251 (also sometimes called a base body 251 herein) having a width 261 (e.g., a diameter). The base 250 can have a length 259 (also sometimes called a base length 259) defined between one end 262-1 and an opposite end 262-2 of the base 250. The body 251 of the base 250 can have any of a number of three-dimensional shapes. For example, the body 251 of the base 250 may be cylindrically shaped. As another example, the body 251 of the base 250 may have the shape of a three-dimensional rectangle. In this case, the base 250 is a single piece. In alternative embodiments, the base 250 may have multiple pieces that are movable (e.g., rotatable) with respect to each other. In such cases, each piece of the base 250 may include one or more coupling features (similar to coupling features 255) that allow adjacent pieces of the body 251 of the base 250 to move relative to each other.

In certain example embodiments, the base 250 includes at least one coupling feature 255. In this case, the base 250 includes a coupling feature 255-1 at or adjacent to end 262-1 and an optional coupling feature 255-2 at or adjacent to end 262-2. Each coupling feature 255 is configured to couple to a coupling feature 235 of an end piece 230. Each coupling feature 255 may be configured to allow the base 250 and an adjacent end piece 230 to be movable (e.g., rotatably movable, slidably movable) with respect to each other.

The body 251 of the base 250 may have formed therein a channel 252 (also sometimes called a base channel 252 herein) that extends along the length 259 (e.g., 2 inches, 3 inches, 4 inches) of the body 251. In some cases, the channel 252 is continuous along the length 259 of the body 251. In some cases, the channel 252 has a width 253 and a depth 254 that are configured to be large enough (e.g., 0.5 inches, 1 inch, 2 inches, 3 inches) to receive a lengthwise portion of a wireline (e.g., wireline 115) of up to a particular size or within a range of particular sizes (e.g., 0.486 inches to 0.567 inches). The width 253 of the channel 252 may be defined by side walls 257, and the depth 254 may be partially defined by a bottom wall 258. The side walls 257 of the channel 252 may be parallel with each other or antiparallel with each other at any point along the length 259 of the body 251. The width 253 of the channel 252 may be substantially constant or variable along the length 259 of the body 251. In some cases, the bottom wall 258 has a curvature 256. In such cases, the curvature 256 of the channel 252 may be substantially constant or variable along the length 259 of the body 251.

The end piece 230-1 of the standoff 200 includes a body 231-1 (also sometimes called an end piece body 231-1 herein) having a diameter 241-1 (or other form of width). The end piece 230-1 can have a length 239-1 (also sometimes called an end piece length 239-1) defined between one end 242-1 and an opposite end 243-1 of the end piece 230-1. The body 231-1 of the end piece 230-1 can have any of a number of three-dimensional shapes. For example, the body 231-1 of the end piece 230-1 may be conically shaped. As another example, the body 231-1 of the end piece 230-1 may have a semi-spherical shape. In this case, the end piece 230-1 is a single piece. In alternative embodiments, the end piece 230-1 may have multiple pieces that are movable (e.g., rotatable) with respect to each other. In such cases, each piece of the end piece 230-1 may include one or more coupling features (similar to coupling feature 235-1) that allow adjacent pieces of the end piece 230-1 to move relative to each other.

In certain example embodiments, the end piece 230-1 includes at least one coupling feature 235-1. In this case, the end piece 230-1 includes a coupling feature 235-1 at or adjacent to end 242-1. Each coupling feature 235-1 is configured to couple to a coupling feature 255-1 of the base 250. Each coupling feature 235-1 may be configured to allow the end piece 230-1 and the base 250 to be movable (e.g., rotatably movable, slidably movable) with respect to each other.

The body 231-1 of the end piece 230-1 may have formed therein a channel 232-1 (also sometimes called an end piece channel 232-1 herein) that extends along the length 239-1 (e.g., 2 inches, 3 inches, 4 inches) of the end piece 230-1. In some cases, the channel 232-1 is continuous along the length 239-1 of the body 231-1. In some cases, the channel 232-1 has a width 233-1 and a depth 234-1 that are configured to be large enough (e.g., 0.5 inches, 1 inch, 2 inches, 3 inches) to receive a lengthwise portion of a wireline (e.g., wireline 115) of up to a particular size or within a range of particular sizes (e.g., 0.486 inches to 0.567 inches). The width 233-1 of the channel 232-1 may be defined by side walls 237-1, and the depth 234-1 may be partially defined by a bottom wall 238-1. The side walls 237-1 of the channel 232-1 may be parallel with each other or antiparallel with each other at any point along the length 239-1 of the body 231-1. The width 233-1 of the channel 232-1 may be substantially constant or variable along the length 239-1 of the body 231-1.

In some cases, the bottom wall 238-1 has a curvature 236-1. In such cases, the curvature 236-1 of the channel 232-1 may be substantially constant or variable along the length 239-1 of the body 231-1. A dimension (e.g., width 233-1, curvature 236-1) of the channel 232-1 of the end piece 230-1 can be the same as, or different than, the corresponding dimension of the channel 252 of the base 250. In certain example embodiments, at least one dimension of the channel 232-1 of the end piece 230-1 differs from the corresponding dimension of the channel 252 of the base 250 to generate a cam effect used to secure a lengthwise-section of a wireline as the end piece 230-1 and the base 250 move relative to each other.

The optional end piece 230-2 of the standoff 200 includes a body 231-2 (also sometimes called an end piece body 231-2 herein) having a diameter 241-2 (or other form of width). The end piece 230-2 can have a length 239-2 (also sometimes called an end piece length 239-2) defined between one end 242-2 and an opposite end 243-2 of the end piece 230-2. The body 231-2 of the end piece 230-2 can have any of a number of three-dimensional shapes. For example, the body 231-2 of the end piece 230-2 may be conically shaped. As another example, the body 231-2 of the end piece 230-2 may have a semi-spherical shape. In this case, the end piece 230-2 is a single piece. In alternative embodiments, the end piece 230-2 may have multiple pieces that are movable (e.g., rotatable) with respect to each other. In such cases, each piece of the end piece 230-2 may include one or more coupling features (similar to coupling feature 235-2) that allow adjacent pieces of the end piece 230-2 to move relative to each other.

In certain example embodiments, the end piece 230-2 includes at least one coupling feature 235-2. In this case, the end piece 230-2 includes a coupling feature 235-2 at or adjacent to end 242-2. Each coupling feature 235-2 is configured to couple to a coupling feature 255-2 of the base 250. Each coupling feature 235-2 may be configured to allow the end piece 230-2 and the base 250 to be movable (e.g., rotatably movable, slidably movable) with respect to each other.

The body 231-2 of the end piece 230-2 may have formed therein a channel 232-2 (also sometimes called an end piece channel 232-2 herein) that extends along the length 239-2 of the end piece 230-2. In some cases, the channel 232-2 is continuous along the length 239-2 (e.g., 2 inches, 3 inches, 4 inches) of the body 231-2. In some cases, the channel 232-2 has a width 233-2 and a depth 234-2 that are configured to be large enough (e.g., 2 inches, 3 inches) to receive a lengthwise portion of a wireline (e.g., wireline 115). The width 233-2 of the channel 232-2 may be defined by side walls 237-2, and the depth 234-2 may be partially defined by a bottom wall 238-2. The side walls 237-2 of the channel 232-2 may be parallel with each other or antiparallel with each other at any point along the length 239-2 of the body 231-2. The width 233-2 of the channel 232-2 may be substantially constant or variable along the length 239-2 of the body 231-2. In some cases, the bottom wall 238-2 has a curvature 236-2. In such cases, the curvature 236-2 of the channel 232-2 may be substantially constant or variable along the length 239-2 of the body 231-2.

When the end piece 230-2 is present, one or more of the characteristics (e.g., shape, size, width 233-2 of the channel 232-2, configuration of the coupling feature 235-2) of the end piece 230-2 can be substantially the same as, or different than, the corresponding characteristics of the end piece 230-1. For example, when the end piece 230-2 is present, a dimension (e.g., width 233-2, curvature 236-2) of the channel 232-2 of the end piece 230-2 can be the same as, or different than, the corresponding dimension of the channel 232-1 of the end piece 230-1. In addition, or in the alternative, when the end piece 230-2 is present, a dimension (e.g., width 233-2, curvature 236-2) of the channel 232-2 of the end piece 230-2 can be the same as, or different than, the corresponding dimension of the channel 252 of the base 250. In certain example embodiments, when the end piece 230-2 is present, at least one dimension of the channel 232-2 of the end piece 230-2 differs from the corresponding dimension of the channel 252 of the base 250 to generate a cam effect used to secure a lengthwise-section of a wireline as the end piece 230-2 and the base 250 move relative to each other.

An example standoff 200 may be configured to be reusable for multiple wireline operations. Specifically, a standoff 200 may be configured to perform multiple cycles of receiving a lengthwise portion of a wireline 115, moving from the default position to a secured position while engaging the wireline 115, returning to the default position while engaging the wireline 115, and being separated from the wireline 115. Alternatively, an example standoff 200 may be configured for use in a single wireline operation. For example, a standoff 200 may be configured such that returning the standoff 200 to the default position from a secured position while engaging the wireline 115 may be destructive to some or all of the standoff 200. If part (e.g., the end piece 230-1) of an example standoff 200 becomes damaged, the standoff 200 may be configured to allow the damaged part to be replaced.

In certain example embodiments, the outer surface of the body 251 of the base 250, the outer surface of the body 231-1 of the end piece 230-1, and/or the outer surface of the body 231-2 of the end piece 230-2 may include one or more features (e.g., coupling features, extensions, receiving features) that are configured to couple to, receive, host, etc. one or more other components that may assist the example standoff 200 in maintaining a fixed position relative to a lengthwise portion of a wireline (e.g., wireline 115) and/or in protecting the wireline from one or more elements within a wellbore (e.g., wellbore 120) throughout the duration of a wireline operation.

When all of the various pieces (e.g., the end piece 230-1, the end piece 230-2, the base 250) are coupled to each other to form the wireline standoff 200, the wireline standoff 200 can have an overall length (e.g., 5 inches, 8 inches, 10 inches) and a maximum diameter (e.g., 2 inches, 3 inches, 4 inches) (or other dimension that defines the maximum outer perimeter of the wireline standoff 200). As discussed above, the channel of each component of the wireline standoff 200 may be configured to receive a wireline (e.g., wireline 115) having a range of diameters. In such a case, the channel 232 (e.g., channel 232-1) of an end piece 230 (e.g., channel 230-1) may be configured to receive a range of diameters of a wireline that overlaps with, whether in whole or in part, the range of diameters of a wireline that may be received by the channel 252 of the base 250.

When the example wireline standoff 200 is fully assembled, the standoff 200 may be configured to withstand one or more of the conditions (e.g., pressure, temperature) present in the wellbore (e.g., wellbore 120) during a wireline and/or other type of subterranean operation. For example, the wireline standoff 200 may be configured to withstand at least 20,000 psi and at least 350° F. for long periods of time (e.g., days, weeks, months) without failing to maintain the relative position of one component (e.g., the base 250) of the standoff 200 with another component (e.g., the end piece 230-1) of the standoff 200 and without otherwise breaking down, breaking apart, and/or sliding along the wireline.

Figure 3A:
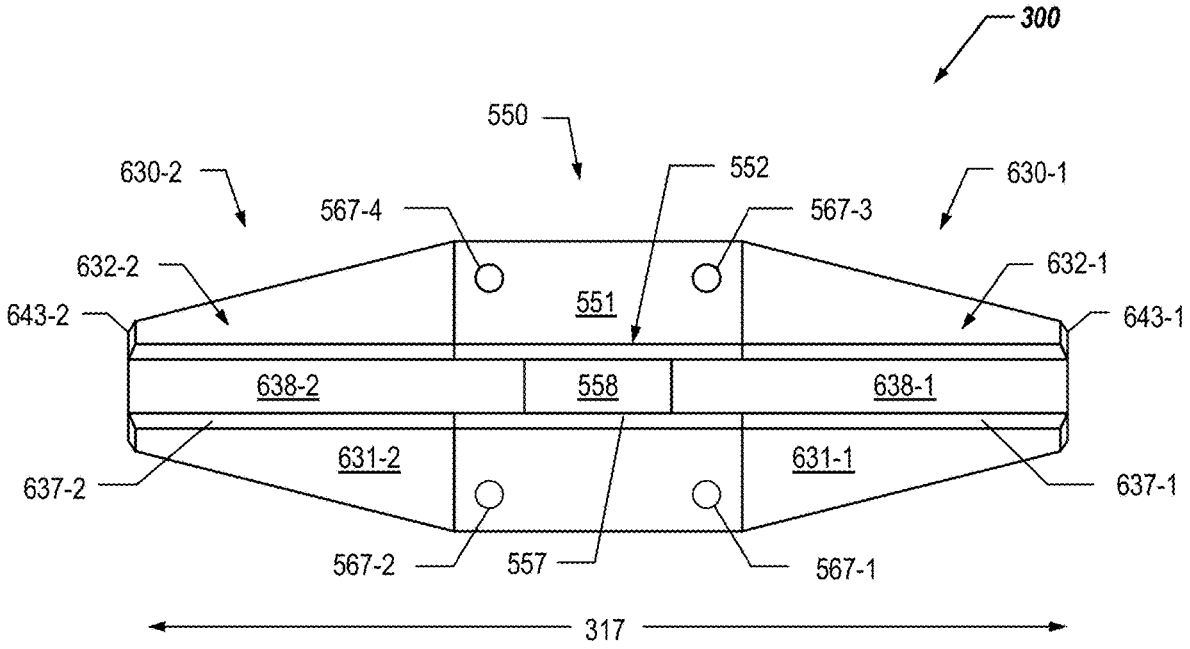
FIGS. 3A through 3C show various views of a wireline standoff in a default position according to certain example embodiments.
Figure 3B:
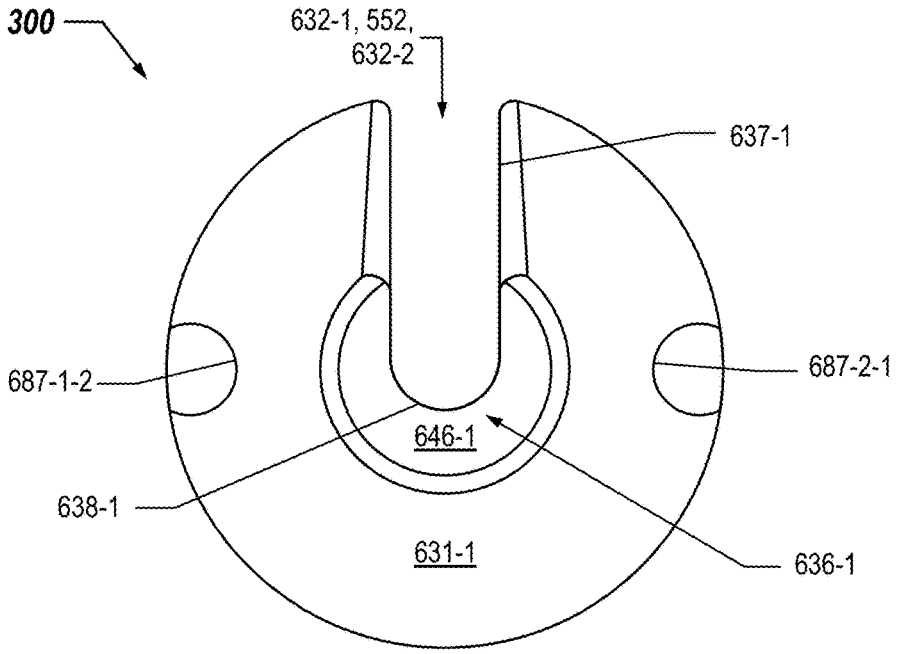
Figure 3C:
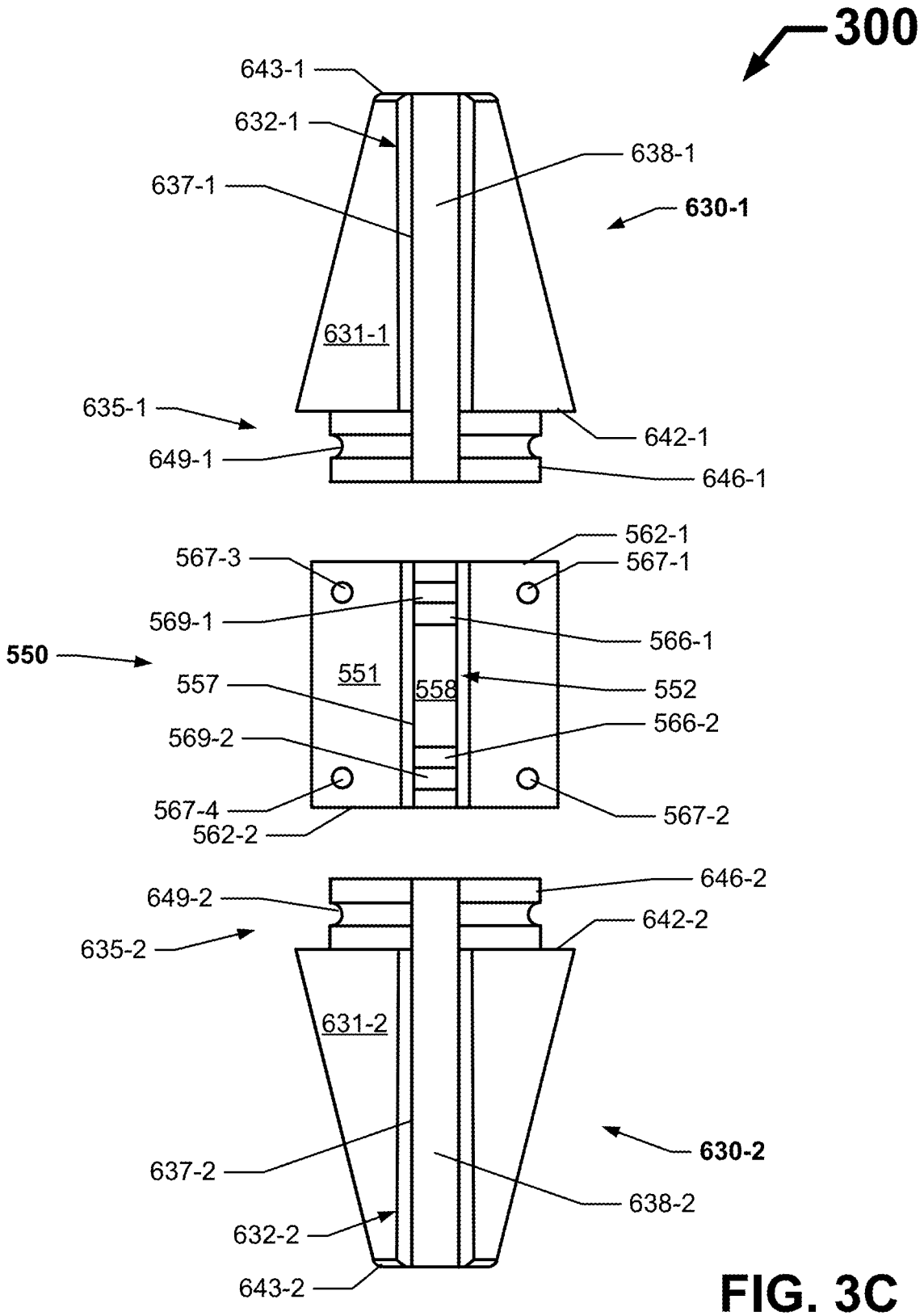

FIGS. 3A through 3C show various views of a wireline standoff 300 in a default position according to certain example embodiments. FIGS. 4A through 4H show various views of the wireline standoff 300 of FIGS. 3A through 3C in a secured position according to certain example embodiments. FIGS. 5A through 5E show various views of the base 550 of the wireline standoff 300 of FIGS. 3A through 4H according to certain example embodiments. FIGS. 6A through 6D show various views of an end piece 630-1 of the wireline standoff 300 of FIGS. 3A through 4H according to certain example embodiments. FIGS. 7A through 7D show various views of the other end piece 630-2 of the wireline standoff 300 of FIGS. 3A through 4H according to certain example embodiments.

Figure 4A:
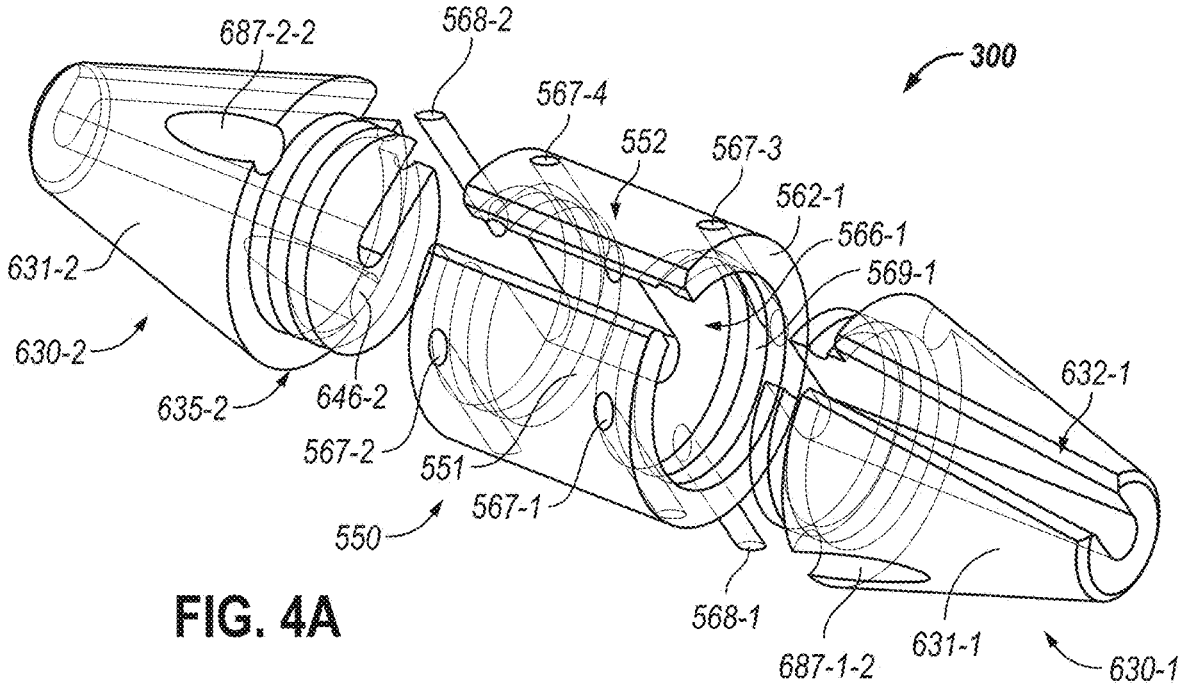
FIGS. 4A through 4H show various views of the wireline standoff of FIGS. 3A through 3C in a secured position according to certain example embodiments.
Figure 4B:
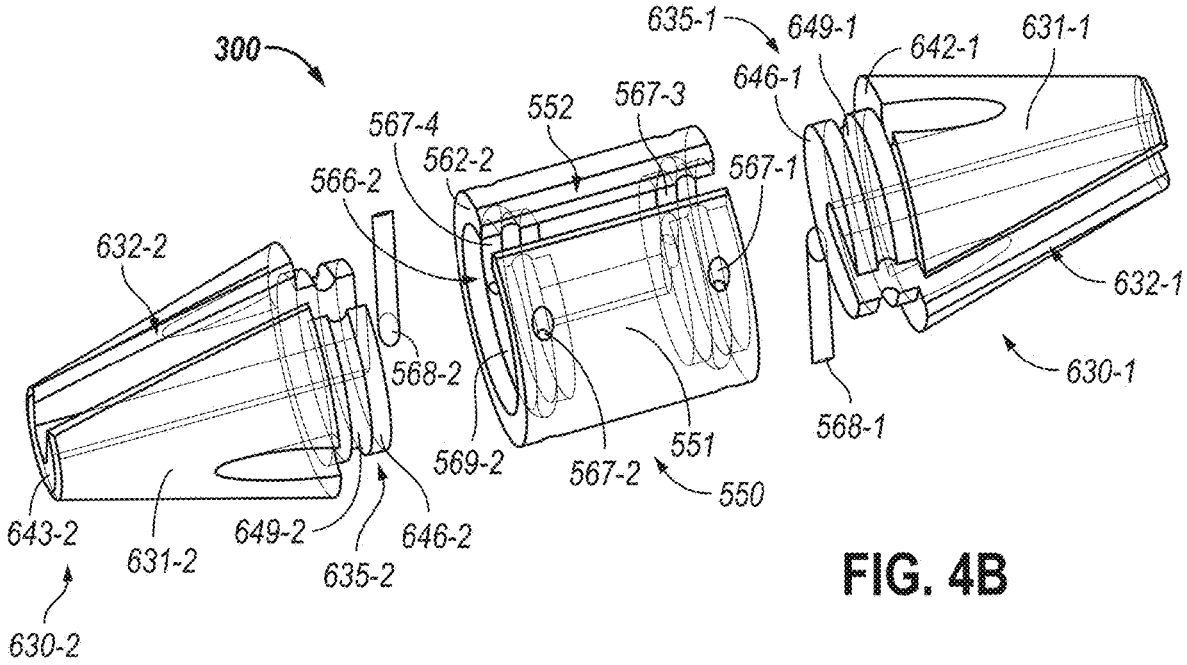
Figure 4C:
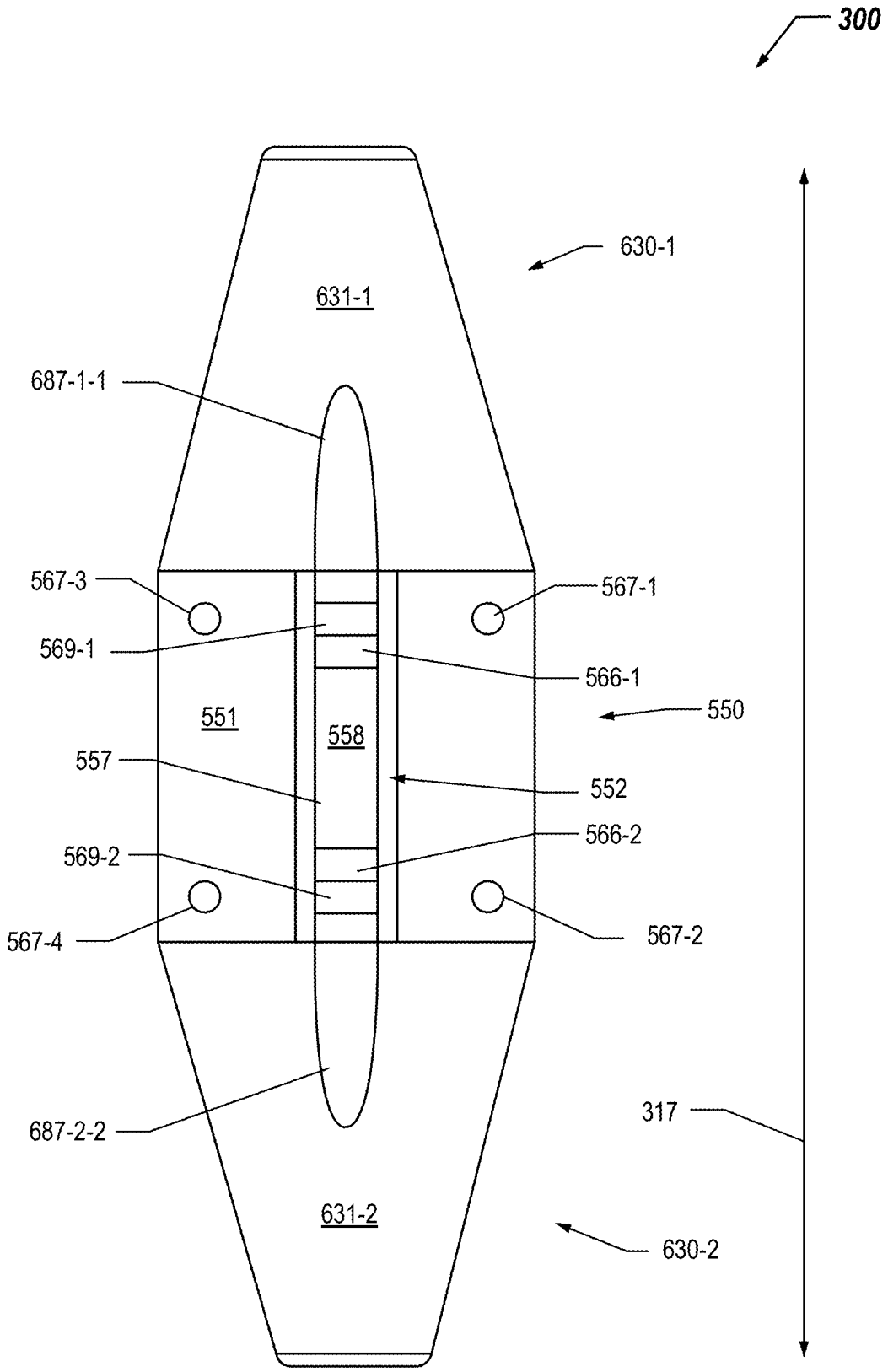
Figure 4D:
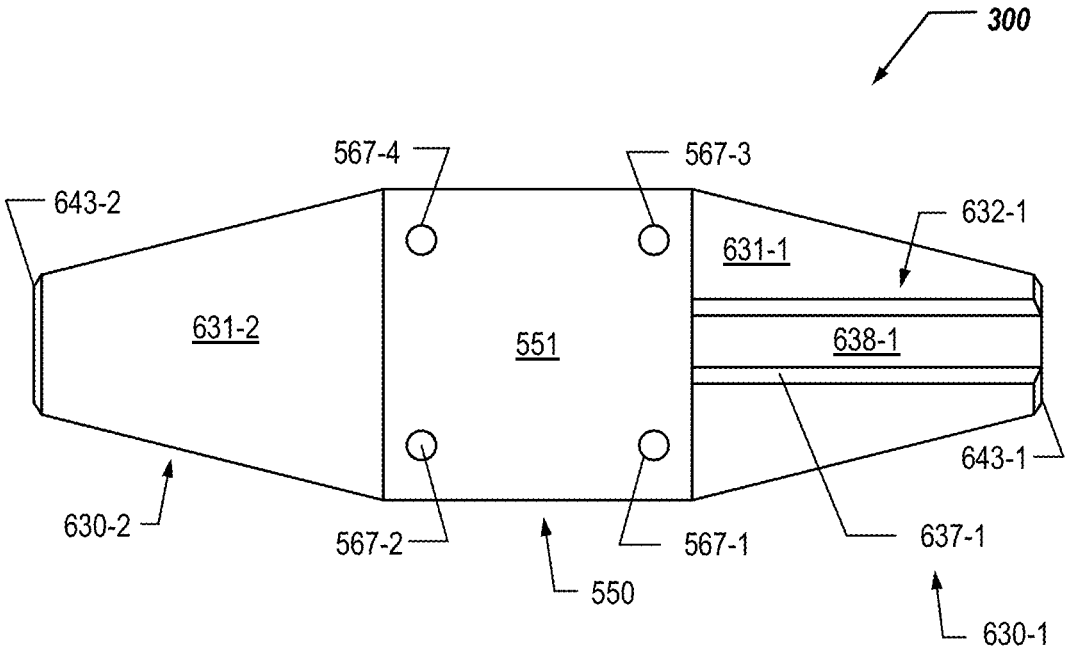
Figure 4E:
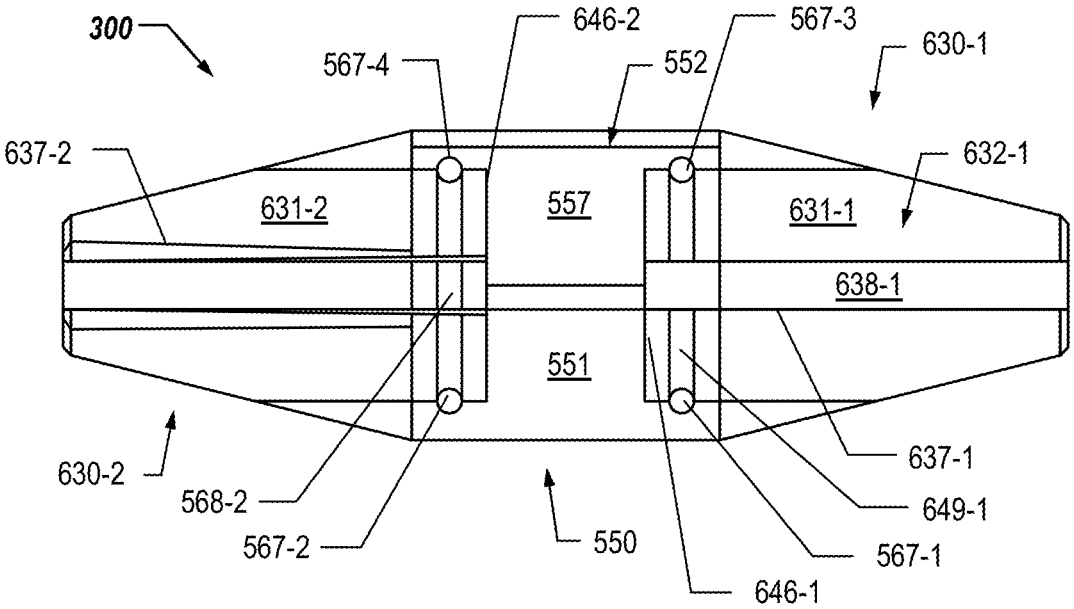
Figure 4F:
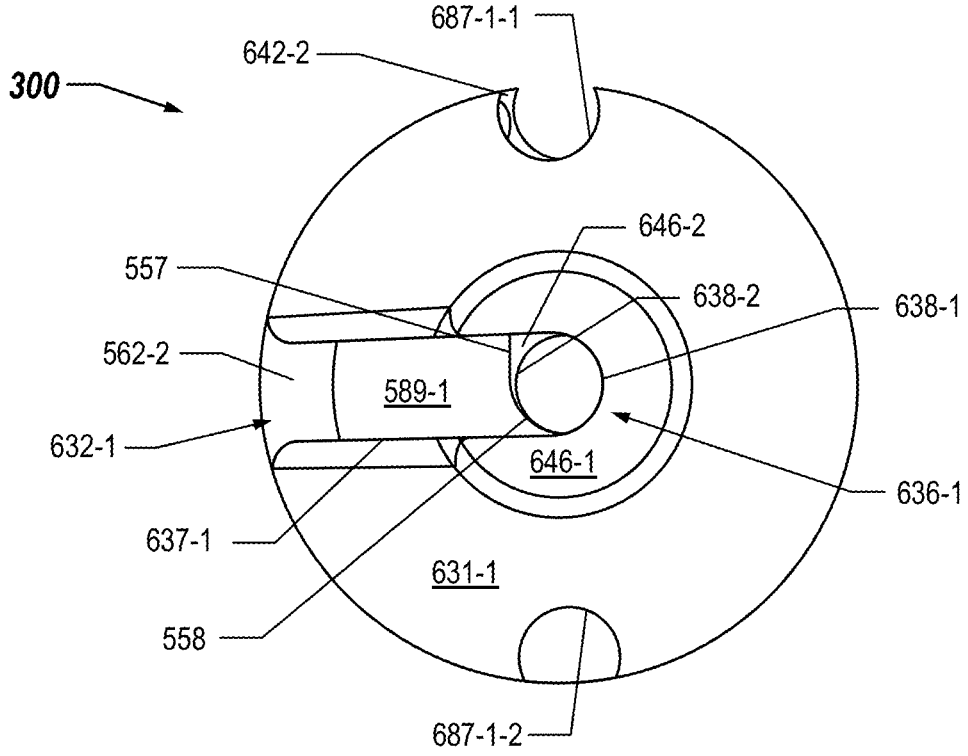
Figure 4G:
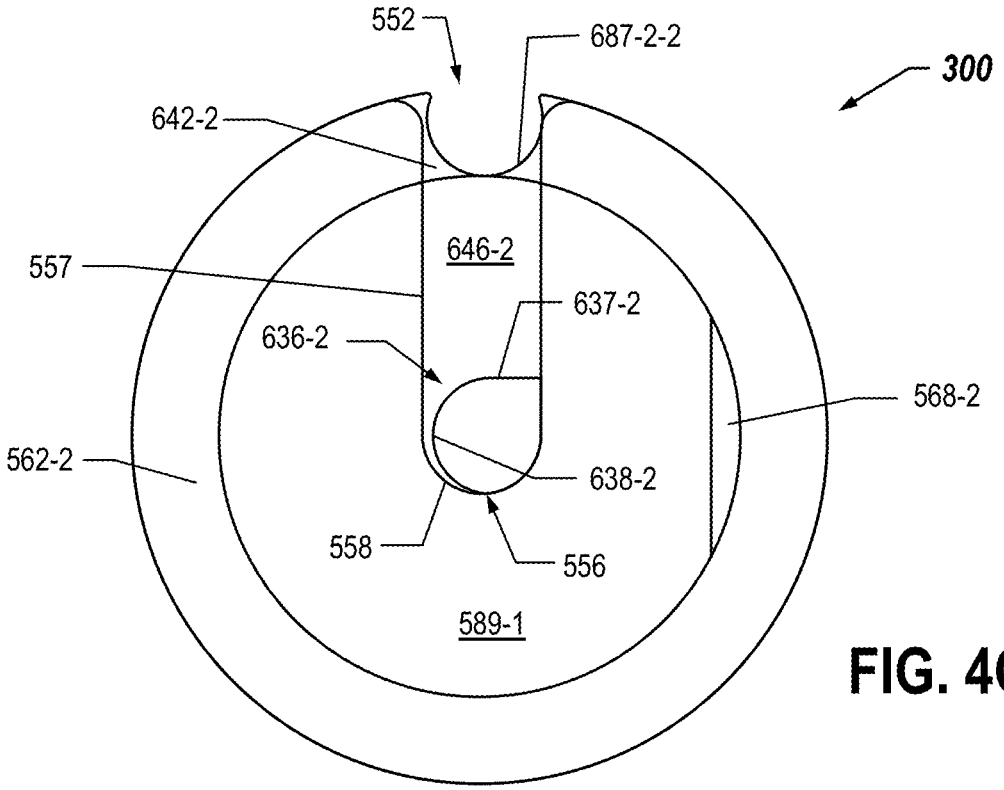
Figure 4H:
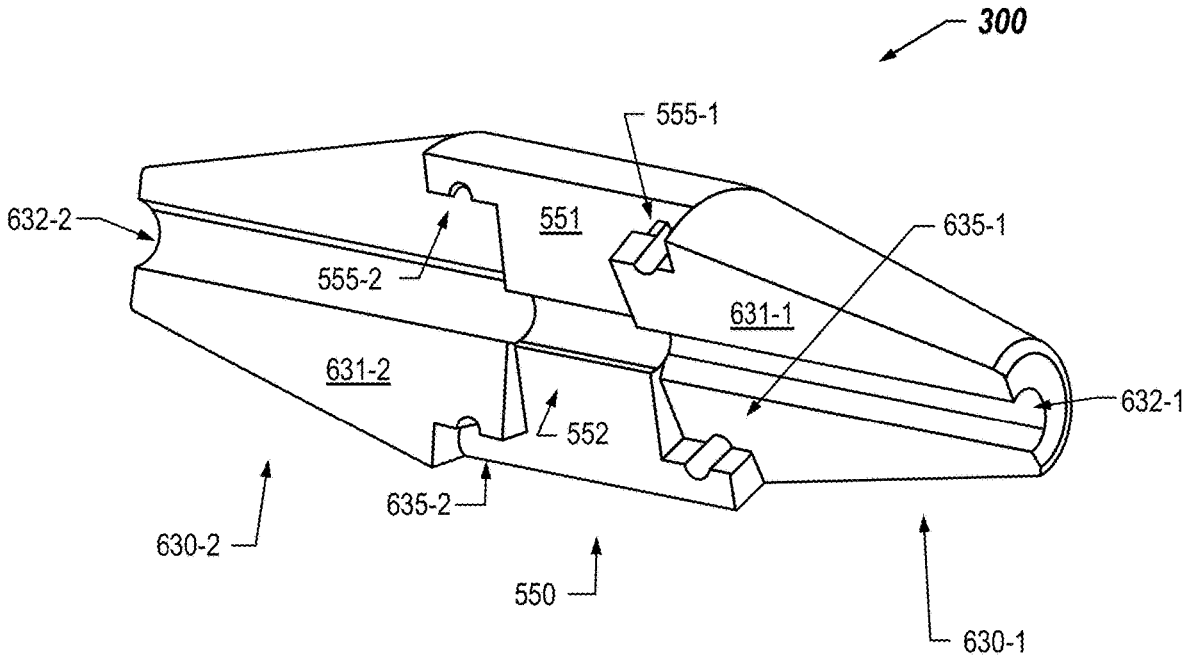

Specifically, FIG. 3A shows a top view of the wireline standoff 300 in the default position. FIG. 3B shows an end view of the wireline standoff 300 in the default position. FIG. 3C shows an exploded top view of the wireline standoff 300 in the default position. FIG. 4A shows a semi-transparent exploded perspective view of the wireline standoff 300 in a partially secured position. FIG. 4B shows another semi-transparent exploded perspective view of the wireline standoff 300 in a partially secured position. FIG. 4C shows a top view of the wireline standoff 300 in a fully secured position. FIG. 4D shows a side view of the wireline standoff 300 in a fully secured position. FIG. 4E shows a sectional side view of the wireline standoff 300 in a fully secured position. FIG. 4F shows a front view of the wireline standoff 300 in a fully secured position. FIG. 4G shows a sectional front view of the wireline standoff 300 in a fully secured position. FIG. 4H shows a sectional side perspective view of the wireline standoff 300 in a fully secured position.

Figure 5A:
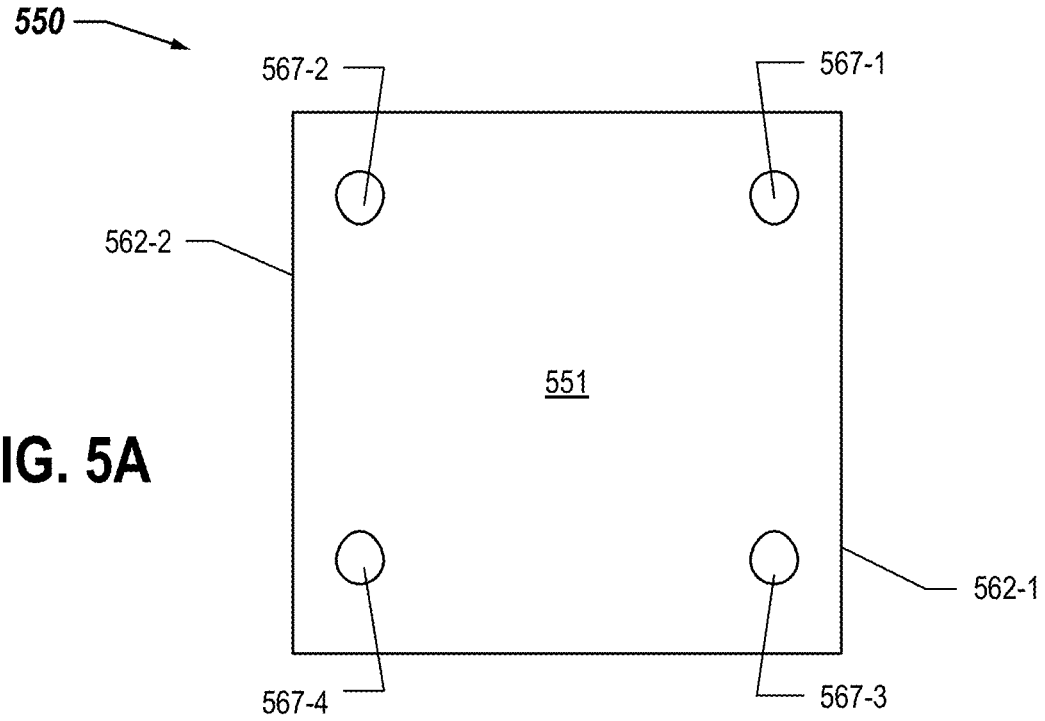
FIGS. 5A through 5E show various views of the base of the wireline standoff of FIGS. 3A through 4H according to certain example embodiments.
Figure 5B:
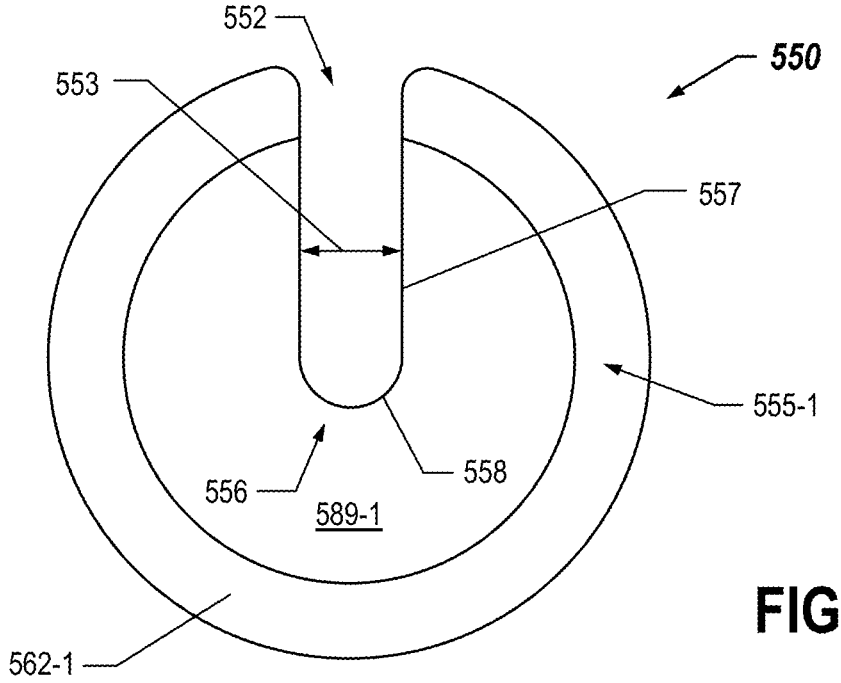
Figure 5C:
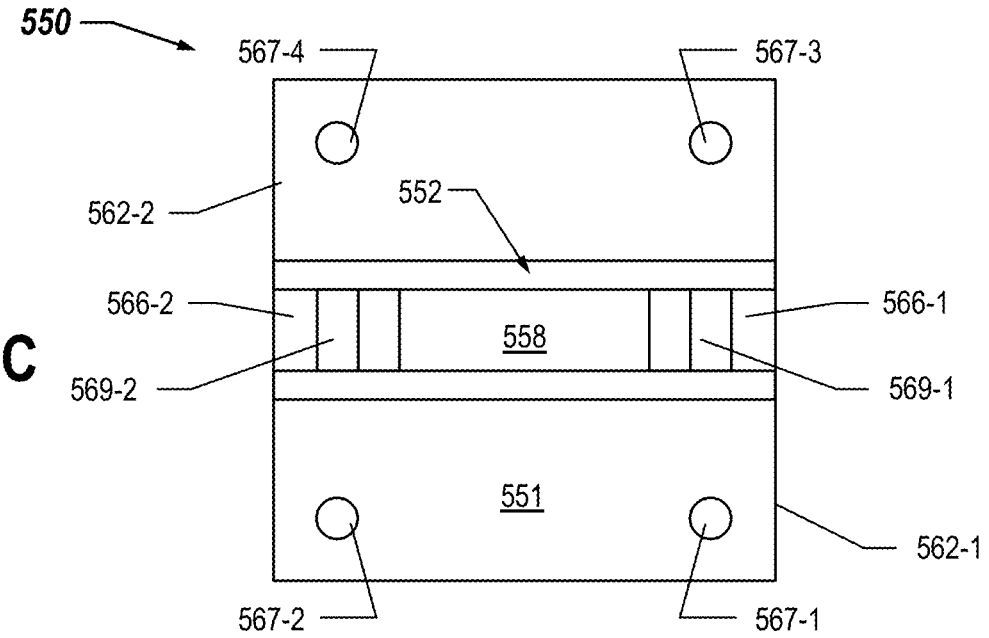
Figure 5D:
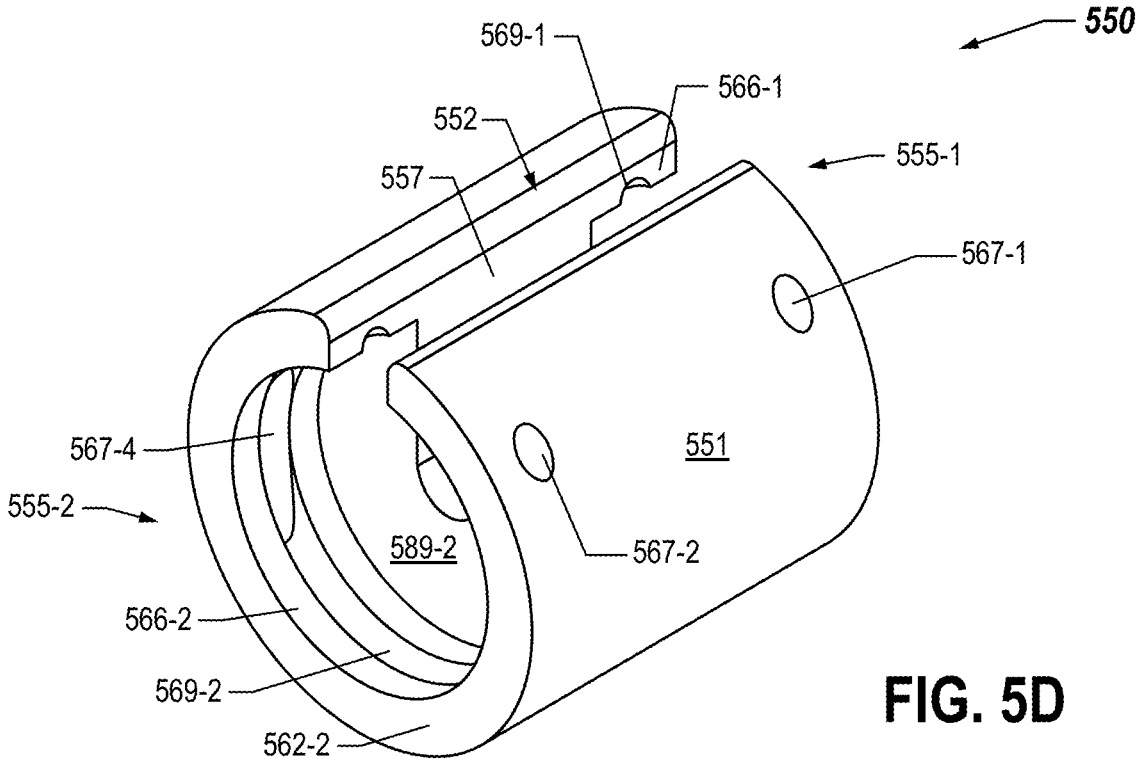
Figure 5E:
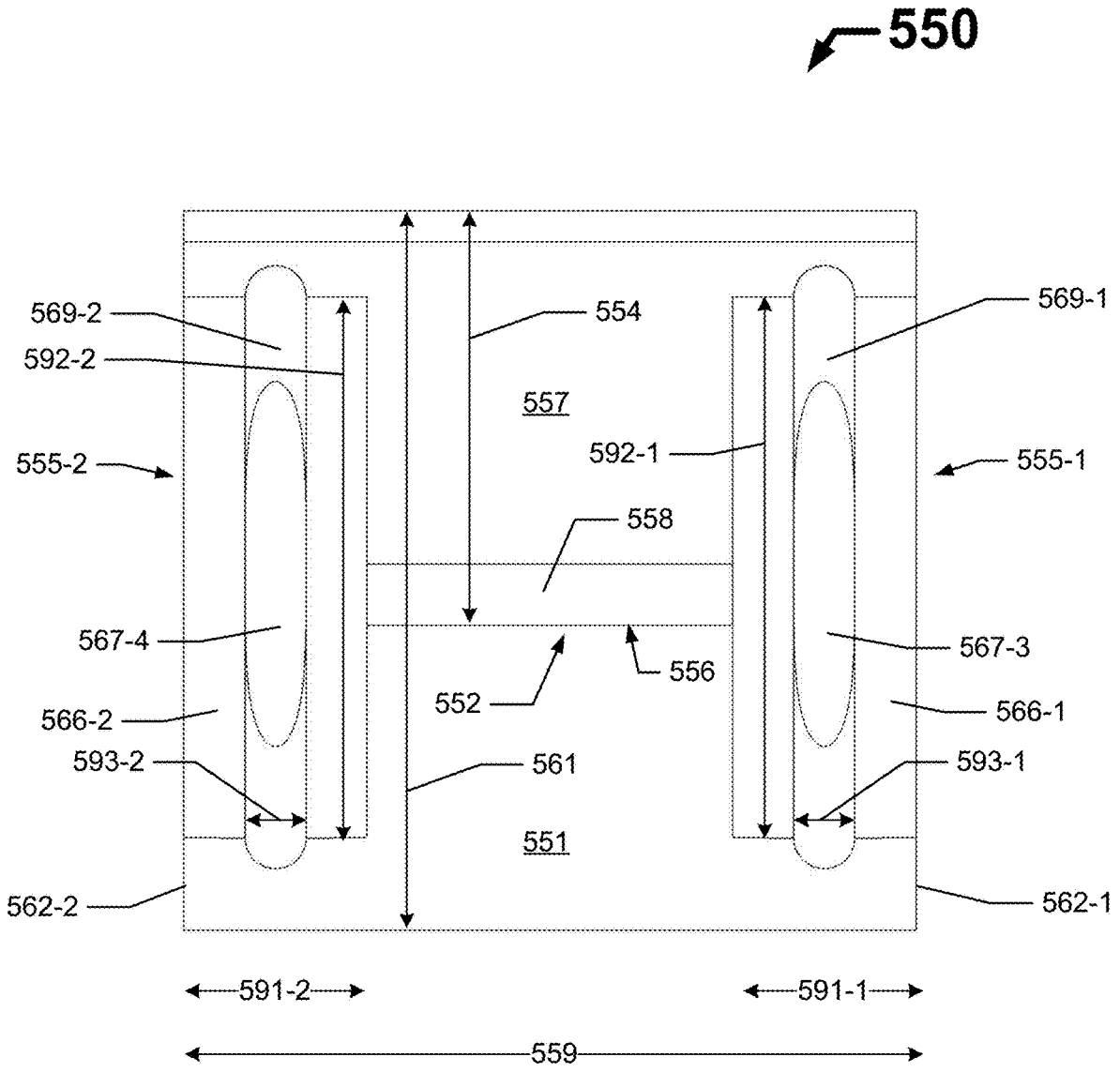

FIG. 5A shows a bottom view of the base 550 of the wireline standoff 300 of FIGS. 3A through 4H. FIG. 5B shows a front view of the base 550 of the wireline standoff 300 of FIGS. 3A through 4H. FIG. 5C shows a top view of the base 550 of the wireline standoff 300 of FIGS. 3A through 4H. FIG. 5D shows a top-side perspective view of the base 550 of the wireline standoff 300 of FIGS. 3A through 4H. FIG. 5A shows a sectional side view of the base 550 of the wireline standoff 300 of FIGS. 3A through 4H.

Figure 6A:
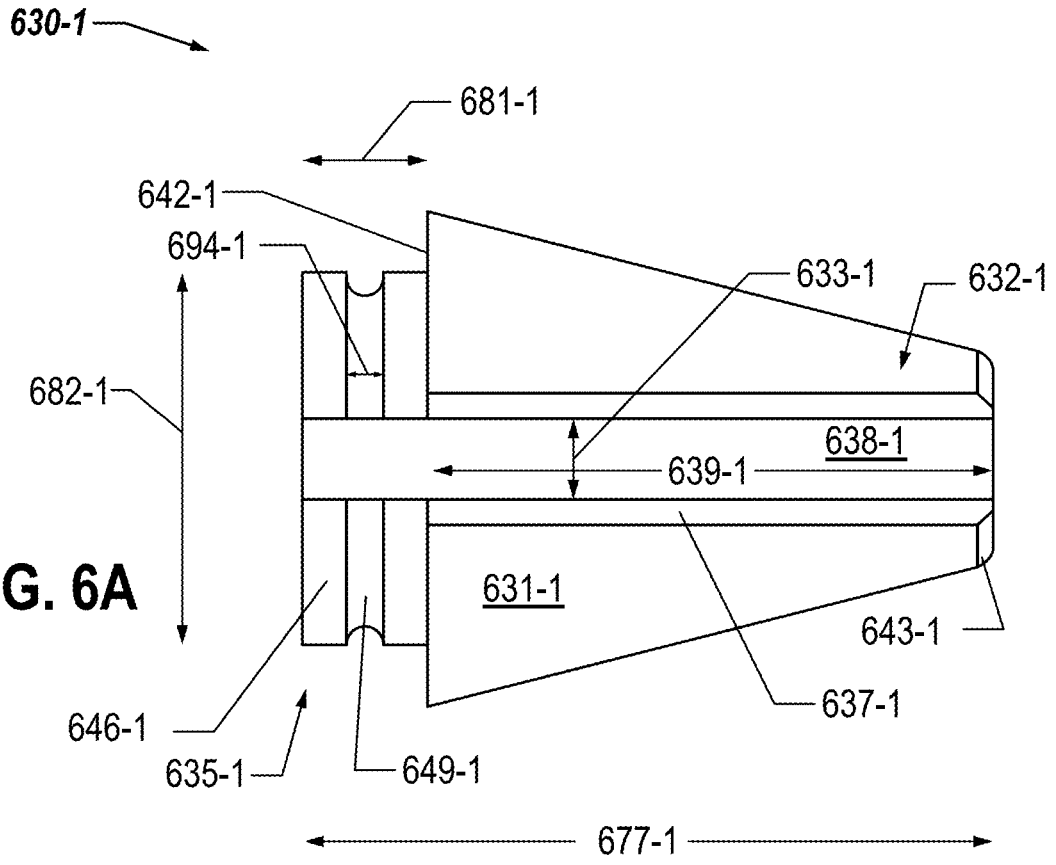
FIGS. 6A through 6D show various views of one end piece of the wireline standoff of FIGS. 3A through 4H according to certain example embodiments.
Figure 6B:
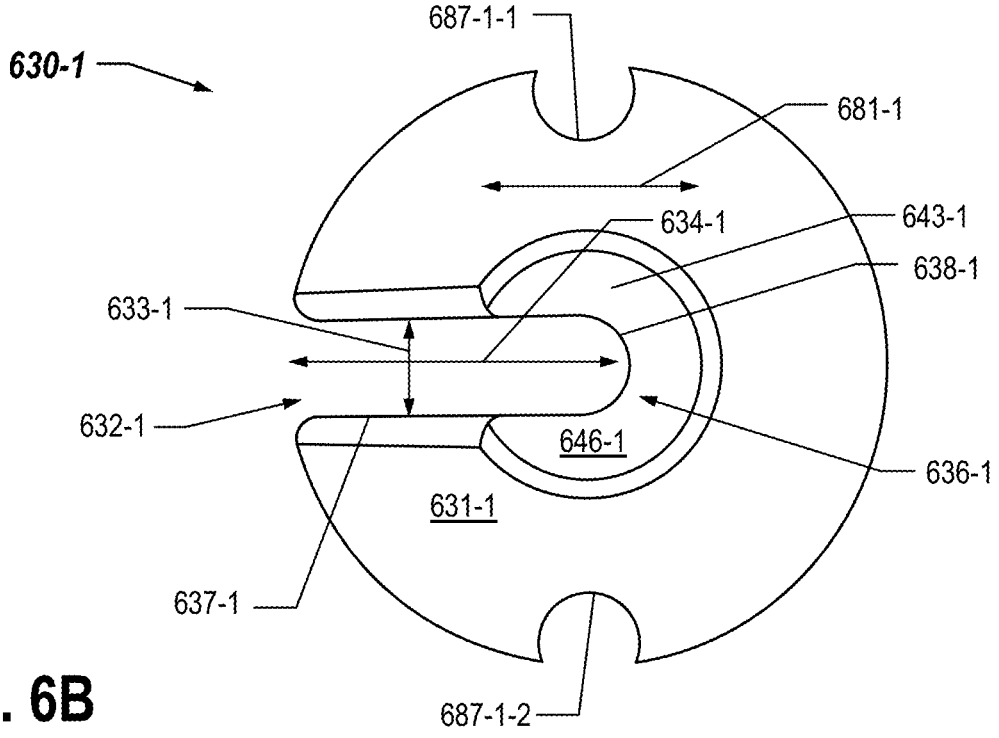
Figure 6C:
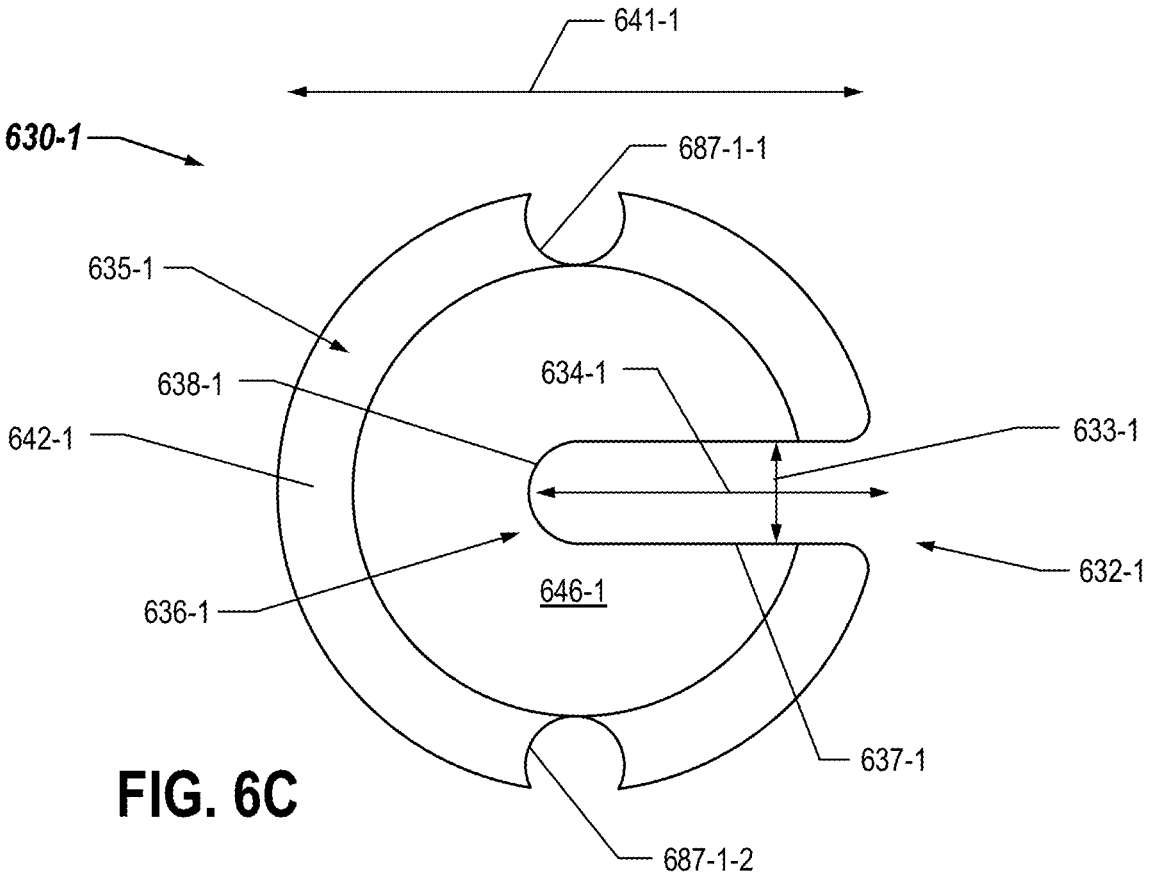
Figure 6D:
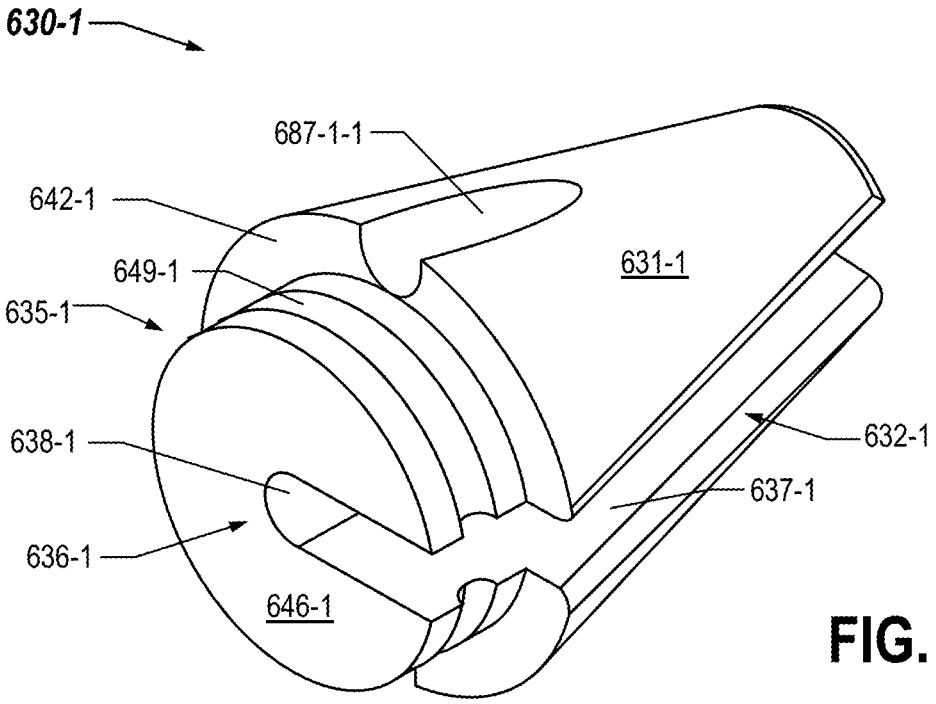
Figure 7A:
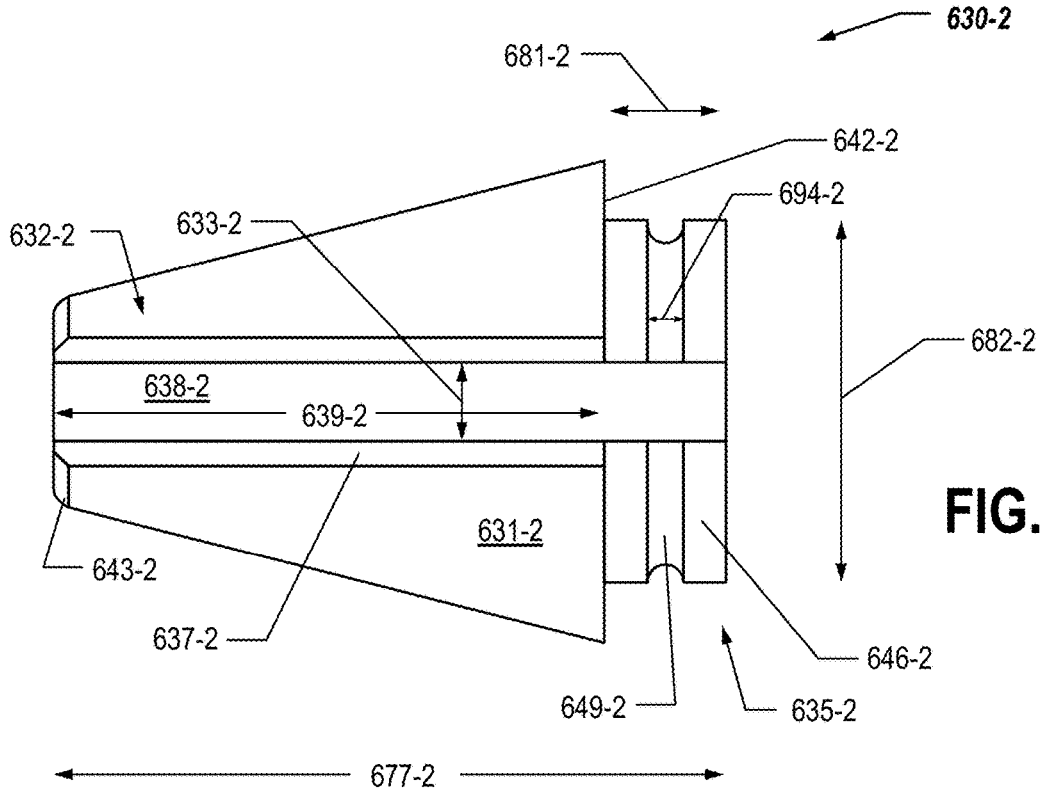
FIGS. 7A through 7D show various views of the other end piece of the wireline standoff of FIGS. 3A through 4H according to certain example embodiments.
Figure 7B:
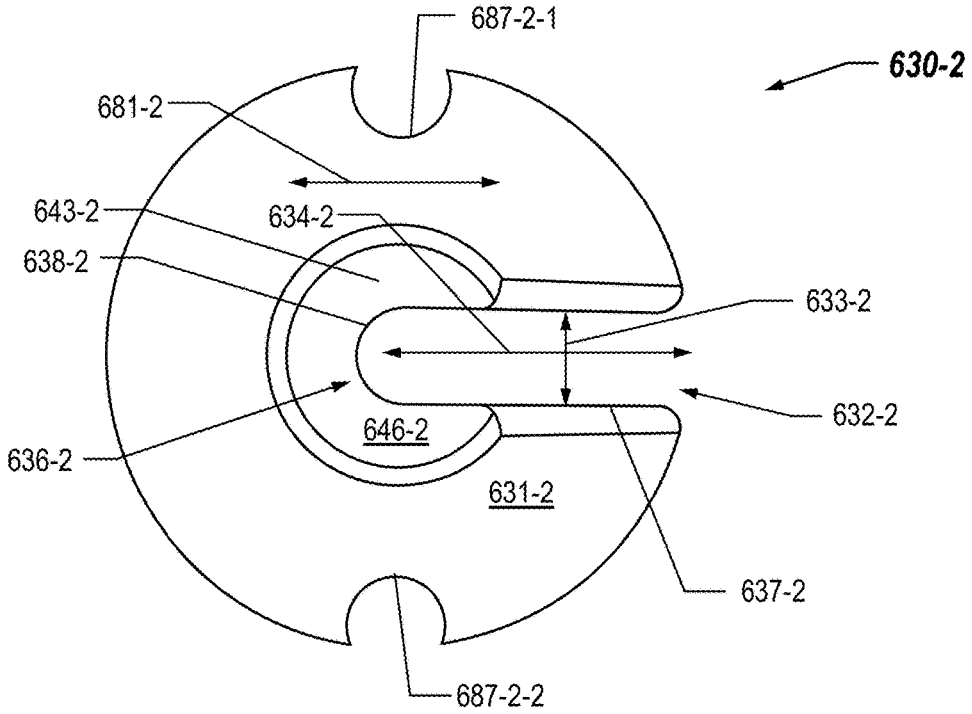
Figure 7C:
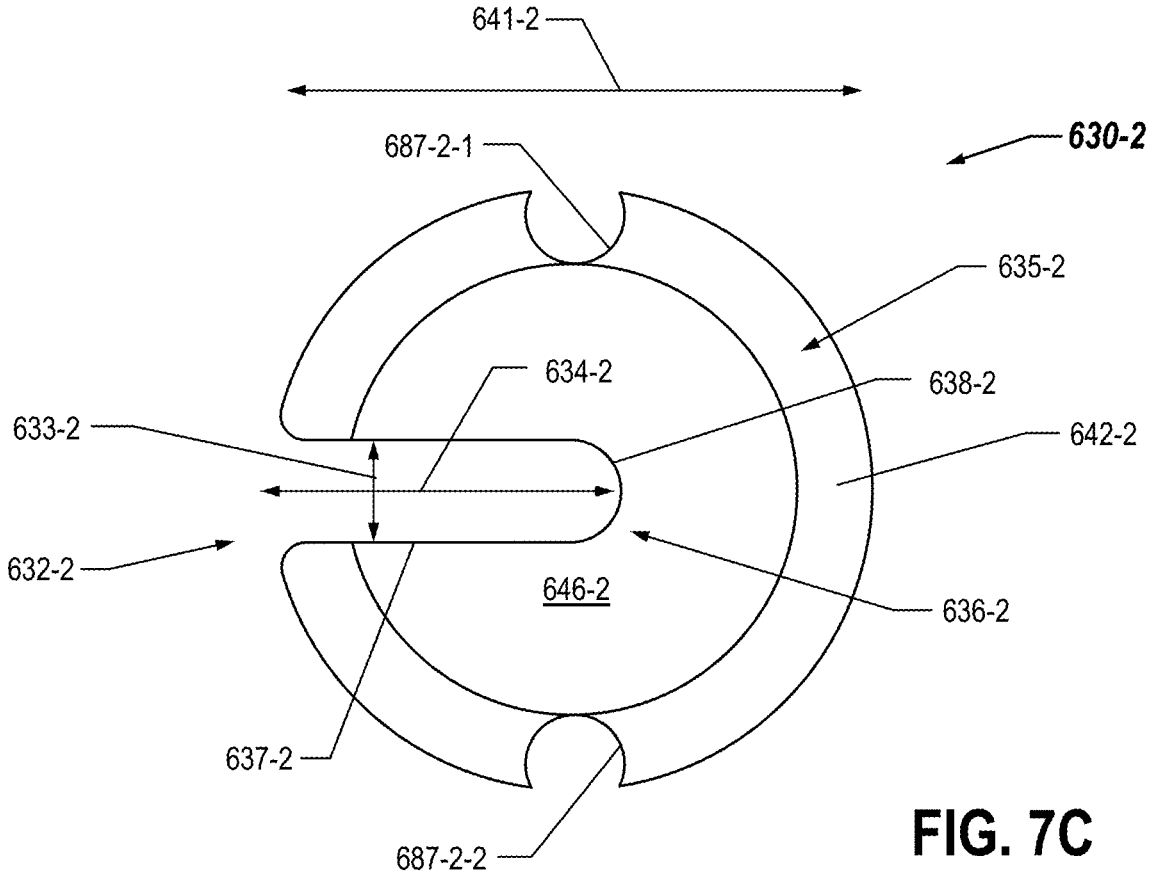
Figure 7D:
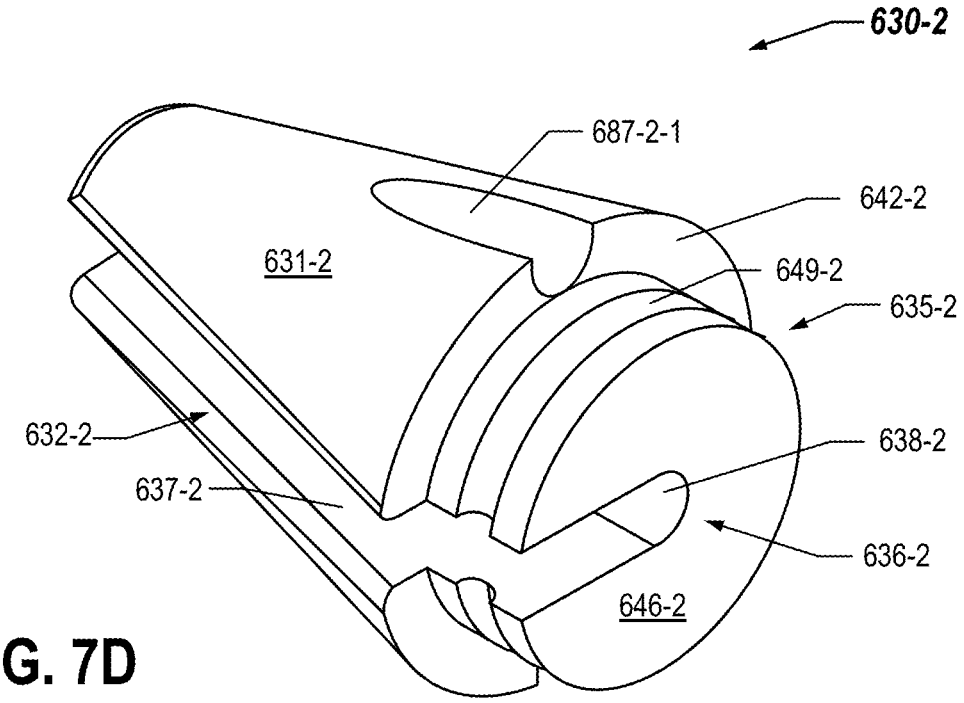

FIG. 6A shows a side view of the end piece 630-1 of the wireline standoff 300 of FIGS. 3A through 4H. FIG. 6B shows a distal end view of the end piece 630-1 of the wireline standoff 300 of FIGS. 3A through 4H. FIG. 6C shows a proximal end view of the end piece 630-1 of the wireline standoff 300 of FIGS. 3A through 4H. FIG. 6D shows a top-end perspective view of the end piece 630-1 of the wireline standoff 300 of FIGS. 3A through 4H. FIG. 7A shows a side view of the end piece 630-2 of the wireline standoff 300 of FIGS. 3A through 4H. FIG. 7B shows a distal end view of the end piece 630-2 of the wireline standoff 300 of FIGS. 3A through 4H. FIG. 7C shows a proximal end view of the end piece 630-2 of the wireline standoff 300 of FIGS. 3A through 4H. FIG. 7D shows a top-end perspective view of the end piece 630-2 of the wireline standoff 300 of FIGS. 3A through 4H.

Referring to FIGS. 1 through 7D, as discussed above, the wireline standoff 300 (also more simply referred to as the standoff 300 herein) in this case includes a base 550 and two end pieces 630 (end piece 630-1 and end piece 630-2). The base 550 of the standoff 300 includes a body 551 (also sometimes called a base body 551 herein). The base 550 has a length 559 (also sometimes called a base length 559) defined between one end 562-1 and an opposite end 562-2 of the base 550. The base 550 also has a width 561 (also sometimes called a base width 561). The body 551 of the base 550 in this example is cylindrically shaped. In this case, the base 550 is a single piece. In certain example embodiments, the body 551 of the base 550 has an outer surface that is wear resistant.

The base 550 has a recess 566-1 at the end 562-1 and a recess 566-2 at the end 562-2. The recess 566-1 has a depth 591-1, defined between the end 562-1 and inner wall 589-1, and a diameter 592-1. The recess 566-2 has a depth 591-2, defined between the end 562-2 and inner wall 589-2, and a diameter 592-2. In this case, the various characteristics (e.g., depth 591-1, diameter 592-1, cross-sectional shape) of recess 566-1 are substantially the same as the corresponding characteristics of recess 566-2. In alternative embodiments, one or more of the characteristics of recess 566-1 may be different than the corresponding characteristics of recess 566-2. In this case, the recess 566-1 is part of a coupling feature 555-1 for the base 550, and the recess 566-2 is part of a coupling feature 555-2 for the base 550.

In this example, coupling feature 555-1 and coupling feature 555-2 are configured substantially the same as each other. Specifically, in addition to the recesses 566, coupling feature 555-1 includes a curved slot 569-1 that traverses the entire perimeter of the recess 566-1, up to both side walls 557 of the channel 552. The curved slot 569-1 has a width 593-1. Similarly, coupling feature 555-2 includes a curved slot 569-2 that traverses the entire perimeter of the recess 566-2, up to both side walls 557 of the channel 552. The curved slot 569-2 has a width 593-2.

The curvature of a slot 569 may be substantially constant or variable along the length of the slot 569. The width 593 of a slot 569 can be substantially constant or variable along the length of the slot 569. In alternative embodiments, a slot 569 of a coupling feature 555 is not curved (e.g., is squared, is semi-hexagonal). The coupling feature 555-1 is configured to couple to coupling feature 635-1 of the end piece 630-1 (discussed below) so that the end piece 630-1 and the base 550 can rotate with respect to each other around the axis along the length 559 of the base 550 and/or around the axis along the length 639-1 of the end piece 630-1, creating a cam effect used to secure a lengthwise-section of a wireline. Similarly, the coupling feature 555-2 is configured to couple to coupling feature 635-2 of the end piece 630-2 (discussed below) so that the end piece 630-2 and the base 550 can rotate with respect to each other around the axis along the length 559 of the base 550 and/or around the axis along the length 639-2 of the end piece 630-2, creating a cam effect used to secure a lengthwise-section of a wireline.

The body 551 of the base 550 has formed therein a channel 552 (also sometimes called a base channel 552 herein) that extends along the length 559 of the body 551. In other words, the channel 552 extends across the entire depth 591-1 of recess 566-1 and the entire depth 591-2 of recess 566-2. The channel 552 is continuous along the length 559 of the body 551. The channel 552 has a width 553 that is substantially constant along the length 559. Where there is no recess 566, the depth 554 of the channel 552 is uniform along the length 559. Also, the width 553 and depth 554 of the channel 552 in this case are large enough to receive a lengthwise portion of a wireline (e.g., wireline 115). The width 553 of the channel 552 may be defined by side walls 557, and the depth 554 may be partially defined (where there is no recess 566) by a bottom wall 558. In this case, the side walls 557 of the channel 552 are parallel to each other along the length 559 of the body 551. The bottom wall 558 in this case has a curvature 556 that is substantially constant along the part of the length 559 of the body 551 where there are no recesses 566.

In certain example embodiments, the body 551 of the base 550 may include one or more features to fix a position between the body 551 and an end piece 630. For example, in this case, the body 551 includes four aperture pairs 567 (aperture pair 567-1, aperture pair 567-2, aperture pair 567-3, and aperture pair 567-4) that traverse part of the body 551. Specifically, aperture pair 567-1 is located adjacent to end 562-1 and is aligned to intersect with part of the slot 569-1 of coupling feature 555-1. Similarly, aperture pair 567-3 is located adjacent to end 562-1, opposite aperture pair 567-1, and is aligned to intersect with another part of the slot 569-1 of coupling feature 555-1. Aperture pair 567-2 is located adjacent to end 562-2 and is aligned to intersect with part of the slot 569-2 of coupling feature 555-2. Similarly, aperture pair 567-4 is located adjacent to end 562-2, opposite aperture pair 567-3, and is aligned to intersect with another part of the slot 569-2 of coupling feature 555-2.

Working in conjunction with the aperture pairs 567 are one or more retention mechanisms 568, where each retention mechanism 568 can be inserted into and/or removed from one of the aperture pairs 567. A retention mechanism 568 can have any of a number of configurations that complement an aperture pair 567. For example, in this case, a retention mechanism 568 may include a rod segment that has its ends tapered to substantially match the curvature of the outer surface of the body 551 adjacent to the aperture pair 567. The various characteristics (e.g., length, tapering at ends, diameter, cross-sectional shape) of a retention mechanism 568 can be configured to complement the corresponding characteristics of the aperture pair 567 that engages the retention mechanism 568.

In this case, there are two retention mechanisms 568 (retention mechanism 568-1 and retention mechanism 568-2). Retention mechanism 568-1 in this case is used to engage aperture pair 567-1, and retention mechanism 568-2 in this case is used to engage aperture pair 567-4. As a result, aperture pair 567-2 and aperture pair 567-3 in this example are not engaged. In alternative embodiments, all of the aperture pairs 567 or different aperture pairs 567 may be engaged by the same number or a greater number of retention mechanisms 568. In this example, a retention mechanism 568 (e.g., retention mechanism 568-1) is configured to be used to engage any of the aperture pairs 567 of the base 550. In alternative embodiments, a retention mechanism 568 may be configured to be used with only one or more, but not all, of the aperture pairs 567 of the base 550.

When the retention mechanism 568-1 is inserted into the aperture pair 567-1, the retention mechanism 568-1 occupies part of the curved slot 569-1 in the recess 566-1 of the coupling feature 555-1 of the base 550 as well as part of the curved slot 649-1 in the extension 646-1 of the coupling feature 635-1 of the end piece 630-1. In this position, the retention mechanism 568-1 generates sufficient friction with the recess 566-1 of the coupling feature 555-1 of the base 550 and the extension 646-1 of the coupling feature 635-1 of the end piece 630-1 to hold or help hold the position of the base 550 and the end piece 630-1 relative to each other.

Similarly, when the retention mechanism 568-2 is inserted into the aperture pair 567-4, the retention mechanism 568-2 occupies part of the curved slot 569-2 in the recess 566-2 of the coupling feature 555-2 of the base 550 as well as part of the curved slot 649-2 in the extension 646-2 of the coupling feature 635-2 of the end piece 630-2. In this position, the retention mechanism 568-2 generates sufficient friction with the recess 566-2 of the coupling feature 555-2 of the base 550 and the extension 646-2 of the coupling feature 635-2 of the end piece 630-2 to hold or help hold the position of the base 550 and the end piece 630-2 relative to each other.

In this configuration, a retention mechanism 568 may have a length that is substantially the same as, or less than, the distance between a corresponding aperture pair 567. In this way, when the retention mechanism 568 is fully inserted into the corresponding aperture pair 567, none of the retention mechanism 568 extends beyond the outer surface of the body 551 of the base 550. This prevents the retention mechanism 568 from becoming a snagging point within the wellbore (e.g., wellbore 120) as the wireline (e.g., wireline 115) is lowered into the wellbore and subsequently extracted from the wellbore. A retention mechanism 568 may be inserted into and/or removed from a corresponding aperture pair 567 with tools (e.g., a screwdriver, a hammer) or without the use of tools (e.g., by hand). The manner in which a retention mechanism 568 is inserted into a corresponding aperture pair 567 may be the same as, or different than, the manner in which the retention mechanism 568 is removed from the corresponding aperture pair 567.

In alternative embodiments, the base 550 may include no aperture pairs 567. In other alternative embodiments, the base 550 may have a single aperture, rather than an aperture pair 567, that traverses the thickness of the body 551. In yet other alternative embodiments, the base 550 may additionally or alternatively include one or more other features (e.g., detents) to fix or help fix a position between the body 551 and an end piece 630.

As detailed in FIGS. 6A through 6D, the end piece 630-1 of the standoff 300 includes a body 631-1 (also sometimes called an end piece body 631-1 herein). The end piece 630-1 can have a length 639-1 (also sometimes called an end piece length 639-1) defined between one end 642-1 and an opposite end 643-1 of the end piece 630-1. The body 631-1 of the end piece 630-1 in this example is conically shaped. Also, in this case, the end piece 630-1 is a single piece. In certain example embodiments, the body 631-1 of the end piece 630-1 has an outer surface that is wear resistant.

The end piece 630-1 includes a coupling feature 635-1 that extends away from the end 642-1 and is configured to couple to the coupling feature 555-1 of the base 550. The coupling feature 635-1 is configured to allow the end piece 630-1 and the base 550 to rotatably move with respect to each other. In this case, the coupling feature 635-1 of the end piece 630-1 includes an extension 646-1 having a length 681-1 and a diameter 682-1. The length 681-1 of the coupling feature 635-1 added to the length 639-1 of the body 631-1 yields an overall length 677-1 of the end piece 630-1. The diameter 682-1 of the coupling feature 635-1 is less than the diameter 641-1 of the end 642-1 of the body 631-1, where the diameter 641-1 of the end 642-1 of the body 631-1 is substantially the same as the width 561 of the body 551 of the base 550.

The various characteristics (e.g., length 681-1, cross-sectional shape, diameter 682-1) of the coupling feature 635-1 complement the corresponding characteristics of the coupling feature 555-1 (including the recess 566-1) of the base 550. The coupling feature 635-1 of the end piece 630-1 also includes a slot 649-1 that extends radially around the entire outer perimeter of the extension 646-1. In this case, the slot 649-1 is curved. The slot 649-1 has a width 694-1. The curvature of the slot 649-1 may be substantially constant or variable along its length. The width 694-1 of the slot 649-1 can be substantially constant or variable along its length. In alternative embodiments, the slot 649-1 of the coupling feature 635-1 is not curved (e.g., is squared, is semi-hexagonal).

The body 631-1 of the end piece 630-1 has formed therein a channel 632-1 (also sometimes called an end piece channel 632-1 herein) that extends along the length 639-1 of the body 631-1 of the end piece 630-1. The channel 632-1 in this case also extends along the entire length 681-1 of the coupling feature 635-1. The channel 632-1 is continuous along the entire length 677-1 of the end piece 630-1. The channel 632-1 has a width 633-1 and a depth 634-1 that are configured to be large enough to receive a lengthwise portion of a wireline (e.g., wireline 115). The width 633-1 of the channel 632-1 is defined by side walls 637-1, and the depth 634-1 is partially defined by a bottom wall 638-1. The side walls 637-1 of the channel 632-1 are substantially parallel with each other along the length 677-1 of the end piece 630-1. The width 633-1 of the channel 632-1 is substantially constant along the length 677-1 of the end piece 630-1. The depth 634-1 of the channel 632-1 is substantially constant along the length 639-1 of the body 631-1 and substantially constant along the length 681-1 of the coupling feature 635-1. The bottom wall 638-1 of the channel 632-1 has a curvature 636-1 that is substantially constant along the length 639-1 of the end piece 630-1.

The body 631-1 of the end piece 630-1 may include one or more alignment indicators 687 to indicate that the standoff 300 (or portions thereof) are in a fully secured position. For example, alignment indicator 687-1-1 and alignment indicator 687-1-2, both in the form of recesses disposed on the outer surface of the body 631-1 adjacent to the coupling feature 635-1 at the end 642-1, may be used to indicate when the end piece 630-1 is in a fully secured position with respect to the base 550. Specifically, as shown in FIG. 4C, when the alignment indicator 687-1-1 is substantially aligned with the channel 552 of the base 550, the end piece 630-1 and the base 550 are in a fully secured position with respect to each other.

In this example, alignment indicator 687-1-1 is positioned approximately 90° counterclockwise from the channel 632-1 of the end piece 630-1, and alignment indicator 687-1-2 is positioned approximately 90° clockwise from the channel 632-1 of the end piece 630-1. In some cases, an alignment indicator 687 of the end piece 630-1 can have any of a number of other forms (e.g., a stencil, a notch, a sticker). The end piece 630-1 may have no alignment indicators 687, a single alignment indicator 687, or more than two alignment indicators 687. When the end piece 630-1 includes multiple alignment indicators 687, the spacing (e.g., equidistant, random) between the alignment indicators 687 may vary. In some cases, an alignment indicator 687 may include a stop or similar feature to limit the range of motion of the end piece 630-1 relative to the base 550.

The end piece 630-2 of the standoff 300 in this example is configured substantially the same as the end piece 630-1 discussed above. For example, the end piece 630-2 of the standoff 300 includes a body 631-2 (also sometimes called an end piece body 631-2 herein). The end piece 630-2 can have a length 639-2 (also sometimes called an end piece length 639-2) defined between one end 642-2 and an opposite end 643-2 of the end piece 630-2. The body 631-2 of the end piece 630-2 in this example is conically shaped. Also, in this case, the end piece 630-2 is a single piece. In certain example embodiments, the body 631-2 of the end piece 630-2 has an outer surface that is wear resistant.

The end piece 630-2 includes a coupling feature 635-2 that extends away from the end 642-2 and is configured to couple to the coupling feature 555-2 of the base 550. The coupling feature 635-2 is configured to allow the end piece 630-2 and the base 550 to rotatably move with respect to each other. In this case, the coupling feature 635-2 of the end piece 630-2 includes an extension 646-2 having a length 681-2 and a diameter 682-2. The length 681-2 of the coupling feature 635-2 added to the length 639-2 of the body 631-2 yields an overall length 677-2 of the end piece 630-2. The diameter 682-2 of the coupling feature 635-2 is less than the diameter 641-2 of the end 642-2 of the body 631-2, where the diameter 641-2 of the end 642-2 of the body 631-2 is substantially the same as the width 561 of the body 551 of the base 550.

The various characteristics (e.g., length 681-2, cross-sectional shape, diameter 682-2) of the coupling feature 635-2 complement the corresponding characteristics of the coupling feature 555-2 (including the recess 566-2) of the base 550. The coupling feature 635-2 of the end piece 630-2 also includes a slot 649-2 that extends radially around the entire outer perimeter of the extension 646-2. In this case, the slot 649-2 is curved. The slot 649-2 has a width 694-2. The curvature of the slot 649-2 may be substantially constant or variable along its length. The width 694-2 of the slot 649-2 can be substantially constant or variable along its length. In alternative embodiments, the slot 649-2 of the coupling feature 635-2 is not curved (e.g., is squared, is semi-hexagonal).

The body 631-2 of the end piece 630-2 has formed therein a channel 632-2 (also sometimes called an end piece channel 632-2 herein) that extends along the length 639-2 of the body 631-2 of the end piece 630-2. The channel 632-2 in this case also extends along the entire length 681-2 of the coupling feature 635-2. The channel 632-2 is continuous along the entire length 677-2 of the end piece 630-2. The channel 632-2 has a width 633-2 and a depth 634-2 that are configured to be large enough to receive a lengthwise portion of a wireline (e.g., wireline 115). The width 633-2 of the channel 632-2 is defined by side walls 637-2, and the depth 634-2 is partially defined by a bottom wall 638-2. The side walls 637-2 of the channel 632-2 are substantially parallel with each other along the length 677-2 of the end piece 630-2. The width 633-2 of the channel 632-2 is substantially constant along the length 677-2 of the end piece 630-2. The depth 634-2 of the channel 632-2 is substantially constant along the length 639-2 of the body 631-2 and substantially constant along the length 681-2 of the coupling feature 635-2. The bottom wall 638-2 of the channel 632-2 has a curvature 636-2 that is substantially constant along the length 639-2 of the end piece 630-2.

The body 631-2 of the end piece 630-2 may include one or more alignment indicators 687 to indicate that the standoff 300 (or portions thereof) are in a fully secured position. For example, alignment indicator 687-2-1 and alignment indicator 687-2-2, both in the form of recesses disposed on the outer surface of the body 631-2 adjacent to the coupling feature 635-2 at the end 642-2, may be used to indicate when the end piece 630-2 is in a fully secured position with respect to the base 550. Specifically, as shown in FIG. 4C, when the alignment indicator 687-2-2 is substantially aligned with the channel 552 of the base 550, the end piece 630-2 and the base 550 are in a fully secured position with respect to each other.

In this example, alignment indicator 687-2-1 is positioned approximately 90° counterclockwise from the channel 632-2 of the end piece 630-1, and alignment indicator 687-2-2 is positioned approximately 90° clockwise from the channel 632-2 of the end piece 630-2. In some cases, an alignment indicator 687 of the end piece 630-2 can have any of a number of other forms (e.g., a stencil, a notch, a sticker). The end piece 630-2 may have no alignment indicators 687, a single alignment indicator 687, or more than two alignment indicators 687. When the end piece 630-2 includes multiple alignment indicators 687, the spacing (e.g., equidistant, random) between the alignment indicators 687 may vary. In some cases, an alignment indicator 687 may include a stop or similar feature to limit the range of motion of the end piece 630-2 relative to the base 550.

The standoff 300 has multiple positions. In other words, the position of the base 550 relative to one or both of the end pieces 630 can change. When the standoff 300 is in the default position, as shown in FIGS. 3A through 3C, the channel 552 of the base 550, the channel 632-1 of the end piece 630-1, and the channel 632-2 of the end piece 630-2 are aligned with each other. This configuration allows the channel 552 of the base 550 to receive a lengthwise portion of a wireline (e.g., wireline 115), the channel 632-1 of the end piece 630-1 to receive another lengthwise portion of the wireline, and the channel 632-2 of the end piece 630-2 to receive yet another lengthwise portion of the wireline substantially simultaneously. Also, when the standoff 300 is in the default position, the standoff 300 has an overall length 317 (e.g., 6 inches, 8 inches, 12 inches).

The standoff 300 may have multiple secured positions. For example, FIGS. 4A and 4B show the standoff 300 in a partially secured position because, while the channel 552 of the base 550 and the channel 632-1 of the end piece 630-1 are aligned with each other, which places the base 550 and the end piece 630-1 in a default position with respect to each other, the channel 552 of the base 550 and the channel 632-2 of the end piece 630-2 are misaligned with each other (also sometimes called offset, raised, recessed, etc. herein), creating a cam effect that places the base 550 and the end piece 630-2 in a secured position with respect to each other. When lengthwise portions of a wireline (e.g., wireline 115) are received in the channel 552 of the base 550 and the channel 632-2 of the end piece 630-2 when the base 550 and the end piece 630-2 are in the default position with respect to each other, as shown in FIGS. 3A through 3C, and subsequently when the base 550 and the end piece 630-2 are moved (e.g., rotated) with respect to each other, creating a cam effect, so that the channel 552 of the base 550 and the channel 632-2 of the end piece 630-2 are misaligned with each other (also sometimes called offset, raised, recessed, etc. herein) as the wireline remains in the channel 552 of the base 550 and the channel 632-2 of the end piece 630-2, the wireline is secured.

For example, the curvature 636-2 of the bottom wall 638-2 of the channel 632-2 of the end piece 630-2 may differ from the curvature 556 of the bottom wall 558 of the channel 552 of the base 550. As another example, the width 633-2 of the channel 632-2 of the end piece 630-2 may differ from the width 553-2 of the channel 552 of the base 550. As another example, the lengthwise axis along which the curvature 636-2 of the bottom wall 638-2 of the channel 632-2 of the end piece 630-2 is based may be misaligned (also sometimes called offset, raised, recessed, etc. herein) with the lengthwise axis along which the curvature 556 of the bottom wall 558 of the channel 552 of the base 550 is based. Any of these examples may result in a gap between the bottom wall 558 of the channel 552 of the base 550 and the bottom wall 638-2 of the channel 632-2 of the end piece 630-2, as shown in FIGS. 4G and 4H, which show an example of how the standoff 300 may engage a wireline (e.g., wireline 115) when the standoff 300 is in such a partially secured position.

Regardless of whether one or more of these examples and/or one or more other methods (e.g., retractable grips in the end piece 630-2 that extend/retract when the end piece 630-2 is rotated relative to the base 550) known to those of ordinary skill in the art are used, when the standoff 300 is placed in a secured position, the standoff 300 remains locked into position relative to the wireline. In other words, when the standoff 300 is placed in a secured position, the standoff 300 does not slide along the wireline. Also, when the standoff 300 is placed in a secured position, the wireline is unable to become retracted from the various channels (e.g., channel 552, channel 632-2) of the standoff 300.

Further, when the standoff 300 is placed in a secured position (as in FIG. 4C), the overall length 317 of the standoff 300 may remain unchanged relative to when the standoff 300 is in the default position (as in FIG. 3A). In alternative embodiments, depending on the configuration and/or inclusion of the various components (e.g., the base 550, the end piece 630-1) of the standoff 300, the overall length 317 of the standoff 300 may vary when the standoff is in a secured position relative to when the standoff 300 is in the default position.

FIGS. 4C through 4F and 4H show the standoff 300 in a fully secured position because the channel 552 of the base 550 and the channel 632-1 of the end piece 630-1 are misaligned with each other (also sometimes called offset, raised, recessed, etc. herein), creating a cam effect that places the base 550 and the end piece 630-1 in a secured position with respect to each other, and because the channel 552 of the base 550 and the channel 632-2 of the end piece 630-2 are misaligned with each other (also sometimes called offset, raised, recessed, etc. herein), which places the base 550 and the end piece 630-2 in a secured position with respect to each other. In the fully secured position, the channel 632-1 of the end piece 630-1 and the channel 632-2 of the end piece 630-2 may generally be aligned with each other or misaligned with each other (also sometimes called offset, raised, recessed, etc. herein), as long as they are each misaligned (also sometimes called offset, raised, recessed, etc. herein) with the channel 552 of the base 550.

The differences between the channel 552 of the base 550 and the channel 632-1 of the end piece 630-1 may be substantially the same as the differences between the channel 552 of the base 550 and the channel 632-2 of the end piece 630-2 discussed above. These differences may prevent the wireline (e.g., wireline 115) from becoming retracted from the channel 552 of the base 550 and the channel 632-2 of the end piece 630-2 and may keep the standoff 300 locked into position relative to the wireline when the base 550 and the end piece 630-2 are in a secured position relative to each other. In this way, as illustrated in FIGS. 4F and 4H, the wireline may be fixed relative to the standoff 300 at the junction of the base 550 and the end piece 630-1 and at the base 550 and the end piece 630-2 when the standoff 300 is in a fully secured position.

The base 550, the end piece 630-1, and/or the end piece 630-2 may include one or more features that limit an amount of movement of one component of the standoff 300 relative to another. For example, the coupling feature 555-1 of the base 550 and/or the coupling feature 635-1 of the end piece 630-1 may include one or more stops (e.g., protrusions, slots, detents) that limit the range of motion of the end piece 630-1 relative to the base 550. A specific example of a configuration of limiting a range of movement between two components in an example standoff is shown in FIGS. 8A and 8B, which show an end piece 830-1 and a base 850, respectively, of a wireline standoff according to certain example embodiments.

Figure 8A:
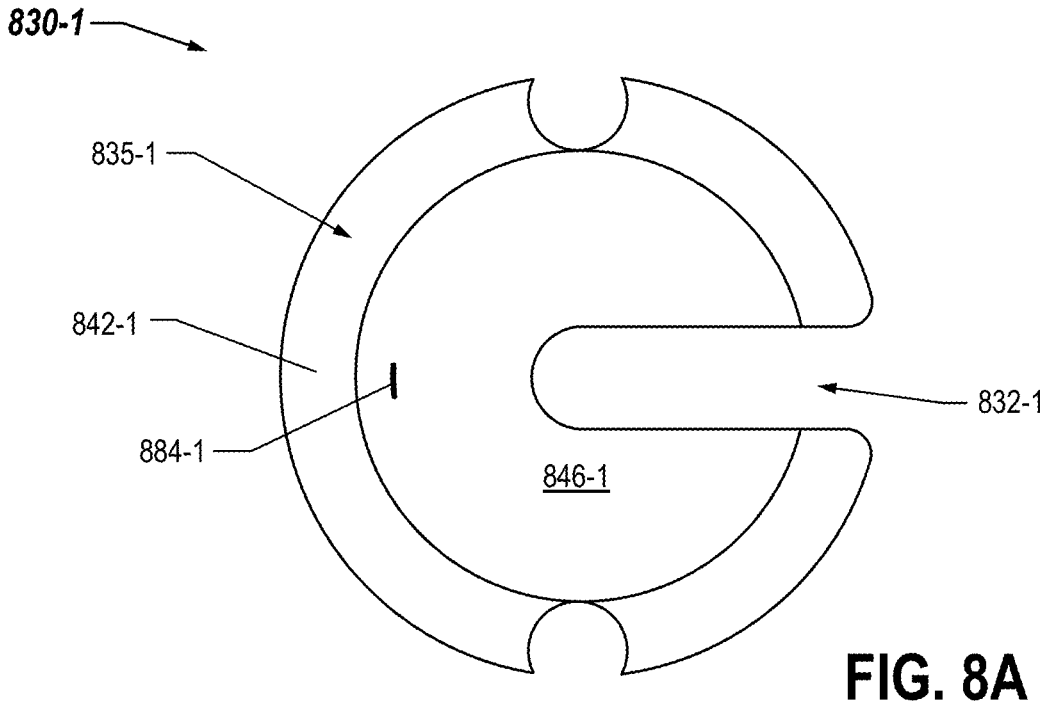
FIGS. 8A and 8B show an end piece and a base, respectively, of a wireline standoff according to certain example embodiments.
Figure 8B:
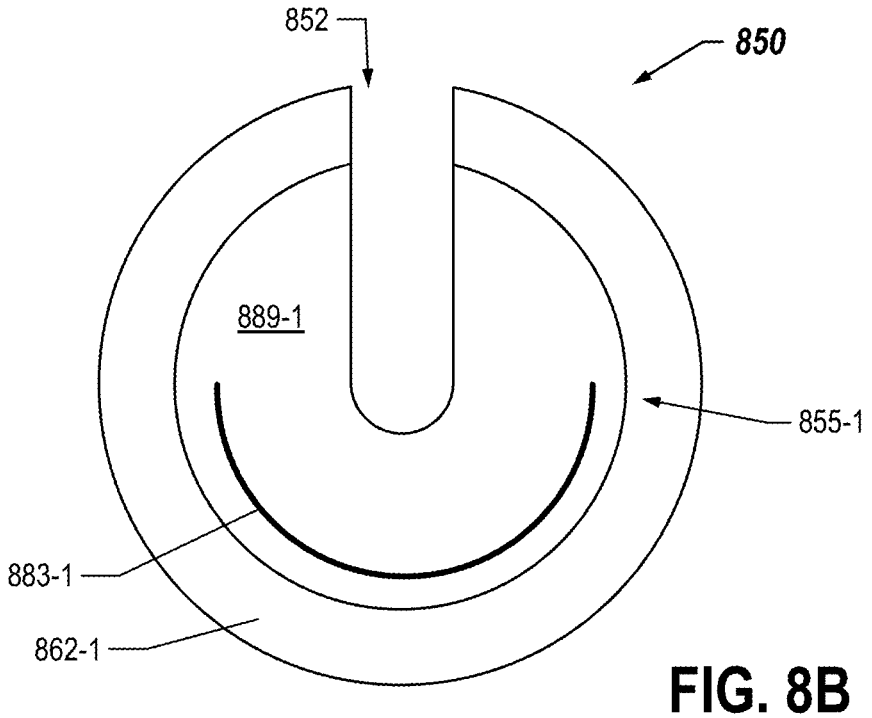

Referring to FIGS. 1 through 8B, the end piece 830-1 and the base 850 of FIGS. 8A and 8B are substantially the same as the end piece 630-1 and the base 550 discussed above, except as discussed below. For example, the proximal end view of the end piece 830-1 of a wireline standoff of FIG. 8A includes a channel 832-1 that traverses the extension 846-1 of the coupling feature 835-1 and part of the end 842-1. In addition, the end piece 830-1 of FIG. 8A includes an extension 884-1 to extends from the end of the extension 846-1 and is located opposite the channel 832-1.

Further, the end view of the base 550 of a wireline standoff of FIG. 8B includes a channel 852 that traverses the end 862 of the body as well as the inner wall 889-1 that defines the coupling feature 855-1. In addition, the inner wall 889-1 of FIG. 8A includes a curved slot 883-1 recessed into it, where the curved slot 883-1 forms a semi-circle that is located opposite the channel 852. When the end piece

830-1 and the base 850 are coupled to each other, the extension 846-1 is configured to fit within the curved slot 883-1. As the end piece 830-1 moves (in this case, rotates) relative to the base 850, the extension 846-1 moves within the curved slot 883-1, creating a cam effect. When the extension 846-1 abuts against an end of the curved slot 883-1, the end piece 830-1 is prevented (stopped) from moving any further in that direction relative to the base 850. In this case, the curved slot 883-1 acts as a stop to limit the range of movement of the end piece 830-1 relative to the base 850.

Example embodiments can be used to provide targeted protection to lengthwise portions of a wireline during a wireline operation. Example embodiments can be installed and securely placed in a secured position in a negligible amount of time, imposing only minimal delays in lowering a wireline into a wellbore. Conversely, example embodiments can be returned to a default position and uninstalled in a negligible amount of time, imposing only minimal delays in retrieving a wireline from a wellbore. Example embodiments can be installed, adjusted, manipulated, and/or uninstalled without the use of tools. Example embodiments may be configured to allow a damaged part to be replaced. Example embodiments may be configured to a single use or multiple uses. Example embodiments may comply with applicable industry standards when used during wireline operations.

Although embodiments described herein are made with reference to example embodiments, it should be appreciated by those skilled in the art that various modifications are well within the scope and spirit of this disclosure. Those skilled in the art will appreciate that the example embodiments described herein are not limited to any specifically discussed application and that the embodiments described herein are illustrative and not restrictive. From the description of the example embodiments, equivalents of the elements shown therein will suggest themselves to those skilled in the art, and ways of constructing other embodiments using the present disclosure will suggest themselves to practitioners of the art. Therefore, the scope of the example embodiments is not limited herein.

What is claimed is:

1. A wireline standoff comprising:

a base comprising a base body having a base length between a first end and a second end, wherein the first end has a first coupling feature, wherein the base body includes a base channel formed therein that extends along the base length of the base body, and wherein the base channel has a width and a depth that are configured to be large enough to receive a first lengthwise portion of the wireline; and an end piece movably coupled to the first end of the base, wherein the end piece comprises an end piece body and a second coupling feature that is configured to couple to the first coupling feature of the base, wherein the end piece body has formed therein an end piece channel that extends along an end piece length of the end piece body, wherein an end piece channel has a width and a depth that are configured to be large enough to receive a second lengthwise portion of the wireline, wherein the base and the end piece are configured to be in a default position when the base channel and the end piece channel are aligned with each other so that the base channel is configured to receive the first lengthwise portion of the wireline simultaneously with when the end piece channel is configured to receive the second lengthwise portion of the wireline, and wherein the base and the end piece are configured to be in a secured position when the end piece is moved relative to the base using the first coupling feature and the second coupling feature so that the base channel and the end piece channel are misaligned with each other while the first lengthwise portion of the wireline is positioned in the base channel and while the second lengthwise portion of the wireline is positioned in the end piece channel.

2. The wireline standoff of claim 1, further comprising:

a second end piece movably coupled to the second end of the base, wherein the second end piece comprises a second end piece body and a third coupling feature that is configured to couple to a second coupling feature at the second end of the base, wherein the second end piece body has formed therein a second end piece channel that extends along a second end piece length of the second end piece body, and wherein the second end piece channel has a width and a depth that are configured to be large enough to receive a third lengthwise portion of the wireline.

3. The wireline standoff of claim 2, wherein the end piece and the second end piece have a substantially similar configuration.

4. The wireline standoff of claim 1, wherein the end piece is rotatably coupled to the base around an axis along the base length of the base.

5. The wireline standoff of claim 1, wherein the first coupling feature at the first end of the base body comprises a stop to limit a range of movement of the end piece relative to the base.

6. The wireline standoff of claim 1, wherein the second coupling feature of the end piece comprises an extension that is configured to be movably positioned within the first coupling feature of the base, where in the first coupling feature comprises a recess.

7. The wireline standoff of claim 1, wherein the base channel has a first curvature, wherein the end piece channel has a second curvature, and wherein a side body of the end piece channel is raised relative to a bottom surface of the base channel when the base and the end piece are in the secured position.

8. The wireline standoff of claim 1, wherein the end piece has a substantially conical shape, and wherein the base has a substantially cylindrical shape.

9. The wireline standoff of claim 1, further comprising:

a retention device that is configured to be disposed within a receiving feature on the base body of the base, wherein the retention device, when engaged with the receiving feature, fixes a position of the end piece relative to the base.

10. The wireline standoff of claim 9, wherein the retention device comprises a pin, and wherein the receiving feature comprises an aperture that traverses the base body proximate to the first end.

11. The wireline standoff of claim 1, wherein the base body has an outer surface that is wear resistant.

12. The wireline standoff of claim 1, wherein the end piece body has disposed on its outer surface an alignment marker that is configured to align with the base channel when the base and the end piece are in the secured position.

13. The wireline standoff of claim 1, wherein the base and the end piece transition from the secured position to the default position when the end piece is moved, using the first coupling feature and the second coupling feature, until the base channel and the end piece channel are aligned with each other.

14. A wireline standoff assembly comprising:

a wireline having a wireline thickness;

a wireline standoff encasing a portion of the wireline, the wireline standoff comprising:

a base comprising a base body having a base length between a first end and a second end, wherein the first end has a first coupling feature, wherein the base body includes a base channel formed therein that extends along the base length of the base body, and wherein the base channel has a width and a depth that are configured to be large enough to receive a first part of the portion of the wireline; and an end piece movably coupled to the first end of the base, wherein the end piece comprises an end piece body and a second coupling feature that is coupled to the first coupling feature of the base, wherein the end piece body has formed therein an end piece channel that extends along an end piece length of the end piece body, wherein the end piece channel has a width and a depth that are configured to be large enough to receive a second part of the portion of the wireline, wherein the base and the end piece are configured to be in a default position when the base channel and the end piece channel are aligned with each other so that the base channel is configured to receive the first part of the portion of the wireline simultaneously with when the end piece channel is configured to receive the second part of the portion of the wireline, and wherein the base and the end piece are configured to be in a secured position when the end piece is moved relative to the base using the first coupling feature and the second coupling feature so that the base channel and the end piece channel are misaligned with each other while the first lengthwise portion of the wireline is positioned in the base channel and while the second lengthwise portion of the wireline is positioned in the end piece channel.

15. The wireline standoff assembly of claim 14, wherein the base and the end piece of the wireline standoff are configured to absorb impacts of a wellbore to protect the portion of the wireline from wear.

16. The wireline standoff assembly of claim 14, wherein the wireline standoff remains affixed to the portion of the wireline when the base and the end piece are in the secured position relative to each other.

17. A wellbore system comprising:

a wellbore disposed in a subterranean formation;

field equipment located at a surface adjacent to the wellbore;

a wireline having a wireline thickness, wherein the field equipment is configured to lower the wireline into and extract the wireline from the wellbore; and a wireline standoff encasing a portion of the wireline, the wireline standoff comprising:

a base comprising a base body having a base length between a first end and a second end, wherein the first end has a first coupling feature, wherein the base body includes a base channel formed therein that extends along the base length of the base body, and wherein the base channel has a width and a depth that are configured to be large enough to receive a first part of the portion of the wireline; and an end piece movably coupled to the first end of the base, wherein the end piece comprises an end piece body and a second coupling feature that is coupled to the first coupling feature of the base, wherein the end piece body has formed therein an end piece channel that extends along an end piece length of the end piece body, wherein the end piece channel has a width and a depth that are configured to be large enough to receive a second part of the portion of the wireline, wherein the base and the end piece are configured to be in a default position when the base channel and the end piece channel are aligned with each other so that the base channel is configured to receive the first part of the portion of the wireline at the surface simultaneously with when the end piece channel is configured to receive the second part of the portion of the wireline, and wherein the base and the end piece are configured to be in a secured position when the end piece is moved relative to the base at the surface using the first coupling feature and the second coupling feature so that the base channel and the end piece channel are misaligned with each other while the first lengthwise portion of the wireline is positioned in the base channel and while the second lengthwise portion of the wireline is positioned in the end piece channel.

18. The wellbore system of claim 17, wherein the portion of the wireline is removed from the base channel and the end piece channel of the wireline standoff at the surface as the wireline is extracted from the wellbore by the field equipment.

19. The wellbore system of claim 18, wherein the end piece is moved at the surface to the default position relative to the base using the first coupling feature and the second coupling feature before the portion of the wireline is removed from the base channel and the end piece channel of the wireline standoff.

20. The wellbore system of claim 17, wherein the wireline standoff protects the portion of the wireline from a feature in the wellbore, and wherein the feature comprises at least one of a group consisting of a casing and a subterranean formation.

* * * * *